US006192732B1

(12) United States Patent
Kojima

(10) Patent No.: US 6,192,732 B1
(45) Date of Patent: Feb. 27, 2001

(54) BENDING METHOD AND BENDING APPARATUS FOR BENDING MACHINE

(75) Inventor: Hiroyuki Kojima, Komatsu (JP)

(73) Assignees: Komatsu Ltd., Tokyo (JP); Komatsu Industries Corporation, Tokyo (JP)

( * ) Notice: Subject to any disclaimer, the term of this patent is extended or adjusted under 35 U.S.C. 154(b) by 0 days.

(21) Appl. No.: 09/254,876

(22) PCT Filed: Sep. 10, 1997

(86) PCT No.: PCT/JP97/03200

§ 371 Date: Mar. 16, 1999

§ 102(e) Date: Mar. 16, 1999

(87) PCT Pub. No.: WO98/14286

PCT Pub. Date: Apr. 9, 1998

(30) Foreign Application Priority Data

| | | |
|---|---|---|
| Oct. 3, 1996 | (JP) | 8-262711 |
| Oct. 11, 1996 | (JP) | 8-269515 |
| Oct. 14, 1996 | (JP) | 8-271056 |
| Oct. 14, 1996 | (JP) | 8-271057 |

(51) Int. Cl.[7] ..... B21D 5/02; B21J 13/04
(52) U.S. Cl. ..... 72/389.5; 72/20.1
(58) Field of Search ..... 72/389.4, 389.5, 72/20.1

(56) References Cited

U.S. PATENT DOCUMENTS 5,329,795 * 7/1994 Sartorio et al. ..... 72/389.5

FOREIGN PATENT DOCUMENTS

| | | | | |
|---|---|---|---|---|
| 2226515 | * | 7/1990 | (GB) | 72/389.5 |
| 2256608 | * | 12/1992 | (GB) | 72/389.5 |
| 2-224821 | | 9/1990 | (JP) . | |
| 3-184626 | | 8/1991 | (JP) . | |
| 4-251614 | | 9/1992 | (JP) . | |
| 5-322551 | | 12/1993 | (JP) . | |
| 5-337554 | * | 12/1993 | (JP) | 72/389.5 |
| 6-15369 | | 1/1994 | (JP) . | |
| 7-39939 | | 2/1995 | (JP) . | |
| 7-16716 | | 3/1995 | (JP) . | |
| 7-112214 | | 5/1995 | (JP) . | |
| 8-32341 | | 3/1996 | (JP) . | |

* cited by examiner

*Primary Examiner*—David Jones
(74) *Attorney, Agent, or Firm*—Armstrong, Westerman, Hattori, McLeland & Naughton

(57) ABSTRACT

A bending method and bending apparatus directed to avoiding the risk of die breakage and damage to ram coupling parts due to an abnormal condition of a ram drive shaft and directed to achieving high-accuracy bending in which a uniform bend angle can be produced throughout the entire length of a workpiece without forming a boat-formed belly. In a press brake having three or more drive shafts, the deformation amounts of the ram and the table at each shaft-load imposed point are calculated based on input bending process data. A target closest distance between the punch and the die at each shaft-load imposed point is calculated from its corresponding deformation amounts. The difference between the actual bend angle of the workpiece after bending and a target bend angle is obtained at at least three positions, that are, the ends and center of the workpiece. From these differences, a correction amount for the moving amount of the ram at each shaft-load imposed point is obtained. Further, an adequate limit for the pressing force to be generated by each drive shaft is calculated based on the bending process data and the ram is driven by independently controlling each drive shaft so as not to generate a pressing force exceeding the set limit. To detect an abnormal situation due to abnormal movement of a drive shaft, a line connecting the positions of the drive shafts disposed at the points corresponding to the ends of the workpiece is obtained and the respective deviations of other drive shafts from the connecting line are obtained. If one of the deviations exceeds a preset allowable value, an abnormal situation is detected.

5 Claims, 29 Drawing Sheets

L = 200 mm

LENGTH OF MACHINE 2550 mm

L = 1000 mm

L = 1800 mm

BENDING METHOD AND BENDING APPARATUS FOR BENDING MACHINE

TECHNICAL FIELD

The present invention relates to a bending method and bending apparatus for use with a bending machine which bends a sheet-like workpiece, utilizing the cooperative movement of a movable die (punch) and a fixed die (die). The movable die is supported by a ram having three or more drive shafts, while the fixed die being supported in an opposing relationship with the movable die by a table both ends of which are secured.

BACKGROUND ART

As such a conventional bending machine, the press brake 51 shown in FIG. 29 is known. In the press brake 51, a ram 52 and a fixed table 53 are disposed, facing each other and a pair of side frames 54, 55 are formed so as to be integral with the ends of the fixed table 53, respectively. Hydraulic cylinders 56 positioned on the respective upper ends of the side frames 54, 55 raise or lower the ram 52. Attached to the lower end of the ram 52 is an upper die (punch) 57. Mounted on the upper face of the fixed table 53 is a lower die (die) 58. A sheet-like workpiece is interposed between these upper and lower dies 57, 58 and pressed with these dies by operating the hydraulic cylinders 56, so that the workpiece can be bent to a desired angle.

When bending a workpiece with such a press brake 51, if the workpiece is shifted to the right or left from the center line C of the machine, the side frame toward which the workpiece is shifted will be deformed more greatly than the other side frame. As a result, the resultant bend angles of the workpiece at its ends differ from each other. An attempt to solve this problem is disclosed in Japanese Patent Publication (KOKAI) Gazette No. 7-39939 (1995). According to the technique disclosed in this publication, the ram is driven with a pair of driving mechanisms (two-point bending) by operating each drive shaft by an operation amount which corresponds to a target bend angle. Then, the angle of the workpiece is measured at both ends and the operation amount of each shaft is corrected according to the difference between the measured bend angle and the target bend angle. Another attempt is disclosed in Japanese Patent Publication (KOKOKU) Gazette No. 8-32341 (1996), which proposes a press brake in which the ram is driven by a right drive shaft and a left drive shaft and crowning is performed to compensate for the mechanical deformation of the press brake caused by bending of the workpiece.

In the press brake shown in FIG. 29, pressing force is generally set for the machine, by adding allowance to the pressing force required for bending, in order to prevent such an undesirable situation that pressing force more than required is exerted on the workpiece during bending operation with resultant damage to the die and punch, because of an error in setting the clearance between the punch and die or the like. Japanese Patent Publication (KOKOKU) Gazette No. 7-16716 (1995) proposes a technique for restricting the force generated by each drive shaft in the case of a press brake having a ram drive shaft on the right and left sides (for two-point bending). In the press brake taught by this publication, in the case of so-called off-center bending in which the bending center of a workpiece is shifted to the right or left from the center of the machine, a limit value for the force of each drive shaft is varied according to bending positions even though the pressing force necessary for bending is the same.

There is known a press brake having a ram drive shaft on the right and left sides, in which abnormal inclination during the movement of the ram is detected by the use of a lever or steel tape coupled to the ram or table, in order to prevent damage to the machine due to the inclination of the dies. Japanese Patent Publication (KOKAI) Gazette No. 3-184626 (1991) teaches use of a software to detect abnormal inclination. The table inclination detector disclosed in the publication No. 3-184626 is designed to have a means for detecting the respective moving positions of the ends of the movable table that carries the movable die. This detecting means compares the positions of the ends to each other when the movable carriage is located near a final target position and releases an alarm if the difference between the end positions exceeds a specified value.

Regarding the technique for compensating for the difference between bend angles at the ends of a workpiece, Japanese Publication (KOKAI) No. 7-39939 encounters the difficulty in obtaining an accurate bend angle over the entire length of a workpiece, since the technique of this publication can compensate for the difference between bend angles by adjusting the amount of inclination, but if crowning becomes necessary to eliminate a "boat form" (i.e., the belly of the workpiece at the center), the amount of inclination should be reevaluated in crowning.

Japanese Patent Publication No. 8-32341 achieves high-accuracy bending in cases where it is applied to center bending in which the center of the machine is coincident with the bending center of the workpiece, but fails in achieving accurate bend angle unless the amount of crowning and the amount of inclination at the right and left sides are adjusted, in the case of "off-center bending" wherein the bending center of the workpiece is shifted from the center of the machine.

The techniques disclosed in the above prior arts have the common problem that it is difficult to crown the ram so as to conform to the deformation of the table which has been arithmetically calculated, because they are applied to a press brake having two ram drive shafts, that is, one at the right side and the other at the left side.

When the techniques for preventing damage to the dies are applied to a press brake having three or more ram drive shafts, it is necessary to alter the limit value of the pressing force generated by each drive shaft in accordance with not only the bending position of the workpiece but also bending length. Because the limit value of the pressing force of each drive shaft varies, depending on bending length even if the pressing force necessary for bending operation is the same. More concretely speaking by way of an example, the pressing force necessary for bending operation is sometimes the same in two cases where a workpiece has small thickness and long bending length and where a workpiece has great thickness and short bending length.

If the limit value of the pressing force to be generated is inadequate, and, more concretely, if the maximum pressing force can be invariably generated, there is the high risk of causing damage to the dies when an error occurs in bending position. On the other hand, if the limit value is set to be equal to the pressing force required for bending irrespective of bending positions and bending length, a shortage of pressing force and, in consequence, poor bending accuracy will be caused depending on bending positions, or excessive pressing force will be generated resulting in damage to the dies in the case of short bending length.

In the techniques for preventing damage to the machine due to the inclination of the dies, which are applied to a press brake having three or more ram drive shafts, errors in the positions of the drive shafts cannot be detected by simply comparing the positions of adjacent drive shafts, unlike the case of the press brake driven by two drive shafts disposed at both ends. In cases where one drive shaft is set as a reference shaft and an alarm is released, if another shaft is deflected from the reference shaft by an amount exceeding a value adjustable by crowning, it is impossible to largely tilt the ram or table by crowning or inclination adjustment. If a reference value is set in compliance with the inclination of the ram or table, the reference value is so large that detection of positional errors cannot be performed in time, resulting in damage to the machine.

The present invention is directed to overcoming the foregoing problems. Accordingly, a primary object of the invention is to provide a bending method and bending apparatus for a bending machine, according to which the ram can be deformed so as to compensate for mechanical deformation caused by bending, thereby achieving a highly accurate, uniform bend angle throughout the entire length of a workpiece without producing a "boat-formed" belly.

A second object of the invention is to provide a bending method and bending apparatus for a bending machine, according to which even if a workpiece is not bent to a target bend angle because of the material, machine or other factors, the angle of the workpiece can be easily adjusted by inputting angle differences measured at the ends and center of the workpiece, thereby achieving a highly accurate, uniform bend angle over the entire length of a workpiece without producing a "boat-formed" belly.

A third object of the invention is to provide a bending method and bending apparatus, which are applicable to a bending machine having three or more ram drive shafts and which can eliminate the risk of causing damage to the dies and provide high-accuracy bending by setting an adequate limit value for pressing force generated by each drive shaft.

A fourth object of the invention is to provide a bending method and bending apparatus, which are applicable to a bending machine having three or more ram drive shafts and which can distinguish the abnormal state due to a positional error in the drive shafts from the state under the adjustment of inclining the ram or forming a crown, so that reliable error detection can be performed, thereby preventing damage to the coupling part of the ram.

DISCLOSURE OF THE INVENTION

The primary object of the invention can be achieved by a bending method for a bending machine according to a first aspect of the invention. This bending method is for use with a bending machine which bends a sheet-like workpiece by the cooperative movement of a movable die and a fixed die, the movable die being supported by a ram having three or more drive shafts, while the fixed die being supported in an opposing relationship with the movable die by a table both ends of which are secured, the bending method comprising the steps of:

- obtaining the deformation amount of the ram and the deformation amount of the table at their respective shaft-load imposed points which correspond to the respective positions of the drive shafts;
- obtaining a target closest distance between the movable die and the fixed die at each shaft-load imposed point according to its associated deformation amounts; and
- driving the ram by independently controlling each drive shaft according to its associated target closest distance.

According to the method having the first feature, the respective deformation amounts of the ram and the table deformed by the load in bending operation are first obtained at the "shaft-load imposed points" on the ram and on the table. Herein, the shaft-load imposed points on the ram and the table are the positions of the ram and the table where the load of the respective drive shafts is exerted and which correspond to the respective positions of the drive shafts. Then, a target closest distance between the movable die and the fixed die at each shaft-load imposed point is obtained from its associated deformation amounts of the ram and the table. According to this target closest distance, the ram, which supports the movable die, is driven by independently controlling each drive shaft. Bending operation is thus carried out while the distance between the movable die and the fixed die at each shaft-load imposed point being controlled. With this arrangement, crowning for compensating for the deformation of the ram which supports the movable die and the deformation of the table which supports the fixed die as well as offset adjustment for adjusting the closest distance between the dies which is affected by crowning or the deflection of members due to bending load can be automatically performed in center bending. In addition, in off-center bending, the ram and the table can be controlled in accordance with their respective actual deformed shapes, so that an accurate bend angle can be obtained throughout the entire length of a workpiece.

The bending method having the first feature can be implemented by a bending apparatus for a bending machine according to a second aspect of the invention. This bending apparatus is for use in a bending machine which bends a sheet-like workpiece by the cooperative movement of a movable die and a fixed die, the movable die being supported by a ram having three or more drive shafts, while the fixed die being supported in an opposing relationship with the movable die by a table both ends of which are secured, the bending apparatus comprising:

(a) die deformation amount calculating means for calculating, according to input bending process data, the deformation amount of the ram and the deformation amount of the table at their respective shaft-load imposed points which correspond to the respective positions of the drive shafts;

(b) closest distance calculating means for calculating, according to the deformation amounts calculated by the die deformation amount calculating means, a target closest distance between the movable die and the fixed die at each shaft-load imposed point; and (c) ram driving means for driving the ram by independently controlling each drive shaft, according to the result of the calculation performed by the closest distance calculating means.

According to the invention, the die deformation amount calculating means calculates, based on bending process data which has been input, the deformation amount of the ram and the deformation amount of the table at their respective shaft-load imposed points. The deformation of the ram and the table results from the load exerted thereon during bending operation. Based on the deformation amounts thus calculated, the closest distance calculating means calculates a target closest distance between the movable die and the fixed die at each shaft-load imposed point. According to the result of this calculation, the ram driving means drives the ram by independently controlling each drive shaft. Like the first feature of the invention, crowning for compensating for the deformation of the ram which supports the movable die and the deformation of the table which supports the fixed die as well as offset adjustment for adjusting the closest distance between the dies which is affected by crowning or the deflection of members due to bending load can be automatically performed in center bending. In addition, in off-center bending, the ram and the table can be controlled in accordance with their respective actual deformed shapes, so that an accurate bend angle can be obtained throughout the entire length of a workpiece.

In the apparatus having the second feature, position detecting means may be further provided for detecting the present position of each shaft-load imposed point of the ram, and the ram driving means may control the ram such that the present position of the ram detected by the position detecting means becomes coincident with a target position. In this case, the position detecting means may be supported by a correction bracket so as to be unaffected by the deflection of the side frames due to changes in load. This arrangement makes it possible to easily obtain a correct amount for compensating for the deflection of the workpiece subjected to bending operation, which contributes to improved bend angle accuracy.

Further, there may be provided input-output means for inputting the bending process data and displaying various data including calculation results.

The second object can be accomplished by a bending method for a bending machine according to a third aspect of the invention. This method is for use with a bending machine which bends a sheet-like workpiece by the cooperative movement of a movable die and a fixed die, the movable die being supported by a ram having three or more drive shafts, while the fixed die being supported in an opposing relationship with the movable die by a table both ends of which are secured, the bending method comprising the steps of:

obtaining the difference between a bend angle of the workpiece after bending operation and a target bend angle at at least three positions, that are, the ends and center of the workpiece; and obtaining, according to the differences, a correction value for the moving amount of the ram at each shaft-load imposed point.

According to the third aspect of the invention, the difference between a bend angle of the workpiece after bending operation and a target bend angle is obtained at at least three positions, that are, the ends and center of the workpiece. These differences are converted into a correction value for the moving amount of the ram at each shaft-load imposed point. With this arrangement, even if the workpiece is not bent to a target bend angle because of material, machine or other factors, a correction amount for each shaft-load imposed point, which is composed of a crowning correction value and an inclination correction value, can be automatically obtained by simply inputting the difference between an actual bend angle and a target bend angle measured at the ends and center of the workpiece. As a result, bend angle correction can be easily carried out and a uniform bend angle can be obtained throughout the entire length of the workpiece.

In this method, it is preferable to convert a crowning correction value and an inclination correction value into a correction value for the moving amount of the ram at each shaft-load imposed point. The crowning correction value is obtained from the deviation of the table position corresponding to the center of the workpiece from a line connecting the table positions that correspond to the ends of the workpiece. The inclination correction value is obtained from the difference between the table positions corresponding to the ends of the workpiece, which difference is obtained from the crowning correction value, and from the difference between bend angles at the right and left of the workpiece.

The bending method having the third feature can be implemented by a bending apparatus for a bending machine according to a fourth aspect of the invention. This bending apparatus is for use in a bending machine which bends a sheet-like workpiece by the cooperative movement of a movable die and a fixed die, the movable die being supported by a ram having three or more drive shafts, while the fixed die being supported in an opposing relationship with the movable die by a table both ends of which are secured, the bending apparatus comprising:

(a) input means for inputting the difference between a bend angle of the workpiece after bending operation and a target bend angle at at least three positions, that are, the ends and center of the workpiece; and (b) correction value calculating means for calculating, according to data input by the input means, a correction value for the moving amount of the ram at each shaft-load imposed point;

(c) closest distance calculating means for calculating, according to the correction value calculated by the correction value calculating means, a target closest distance between the movable die and the fixed die at each shaft-load imposed point; and (d) ram driving means for driving the ram by independently controlling each drive shaft, according to the result of the calculation performed by the closest distance calculating means.

According to the fourth aspect of the invention, the difference between the bend angle of the workpiece after bending operation and a target bend angle is obtained at at least three points of the workpiece (i.e., the ends and center of the workpiece). The difference is input by the input means, and according to this input data, the correction value calculating means calculates a correction value for the moving amount of the ram at each shaft-load imposed point. A target closest distance between the movable die and the fixed die at each shaft-load imposed point is calculated based on this correction value. According to the result of the calculation, the ram driving means drives the ram by independently controlling each drive shaft. Accordingly, even if the workpiece is not bent to a target bend angle because of material, machine or other factors, a correction amount for each shaft-load imposed point, which is composed of a crowning correction value and an inclination correction value, can be automatically obtained by simply inputting the difference between and an actual bend angle and a target bend angle measured at the ends and center of the workpiece, and with this correction value, the ram is driven on a drive shaft basis. As a result, bend angle correction can be easily carried out based on input data and a uniform bend angle can be obtained throughout the entire length of the workpiece.

In this method, it is preferable to convert a crowning correction value and an inclination correction value into a correction value for the moving amount of the ram at each shaft-load imposed point. The crowning correction value is obtained from the deviation of the table position that corresponds to the center of the workpiece from a line connecting the table positions that correspond to the ends of the workpiece. The inclination correction value is obtained from the difference between the table positions corresponding to the ends of the workpiece, which difference is obtained from the crowning correction value, and from the difference between bend angles at the right and left of the workpiece.

The third object can be accomplished by a bending method for a bending machine according to a fifth aspect of the invention. This bending method is for use with a bending machine which bends a sheet-like workpiece by the cooperative movement of a movable die and a fixed die, the movable die being supported by a ram having three or more drive shafts, while the fixed die being supported in an opposing relationship with the movable die by a table both ends of which are secured, the bending method comprising the steps of:

obtaining a limit value of pressing force generated by each drive shaft according to bending process data used for controlling the operation of each drive shaft; and driving the ram by independently controlling each drive shaft according to the limit value.

The bending method having the fifth feature can be implemented by a bending apparatus for a bending machine according to a sixth aspect of the invention. This bending apparatus is for use in a bending machine which bends a sheet-like workpiece by the cooperative movement of a movable die and a fixed die, the movable die being supported by a ram having three or more drive shafts, while the fixed die being supported in an opposing relationship with the movable die by a table both ends of which are secured, the bending apparatus comprising:

(a) input means for inputting bending process data used for controlling the operation of each drive shaft;

(b) limit value calculating means for calculating a limit value of pressing force generated by each drive shaft according to the bending process data input by the input means; and (c) ram driving means for driving the ram by independently controlling each drive shaft, according to the result of the calculation performed by the limit value calculating means.

According to the fifth and sixth aspects, a limit value of pressing force generated by each drive shaft is obtained according to bending process data (e.g., the V-groove width of the fixed die, the thickness, bending length and tensile strength of the workpiece) used for controlling the operation of each of three or more drive shafts provided for the ram. The ram is then driven by independently controlling each drive shaft such that the pressing force generated by each drive shaft does not exceed its limit value. With this arrangement, necessary pressing force per drive shaft, which varies depending on the bending length and bending position of the workpiece, can be obtained. Therefore, in cases where the same pressing force is required for bending with different bending lengths or in the case of off-center bending where the center of bending is shifted to the right or left, damage to the dies due to an error in setting a bending position can be minimized and poor bending accuracy due to a shortage of pressing force can be avoided. This results in high-accuracy bending.

Preferably, the limit value calculating means of the apparatus having the sixth feature obtains the pressing force necessary for bending from the bending process data input by the input means and calculates a limit value of pressing force generated by each drive shaft according to the bending length and bending position of the workpiece, based on the above pressing force to which an allowance inherent to the bending machine is added.

The fourth object can be accomplished by a bending method for a bending machine according to a seventh aspect of the invention. This bending method is for use with a bending machine which bends a sheet-like workpiece by the cooperative movement of a movable die and a fixed die, the movable die being supported by a ram having three or more drive shafts, while the fixed die being supported in an opposing relationship with the movable die by a table both ends of which are secured, the bending method being characterized in that when obtaining a target position of the movable die for each drive shaft from input bending process data, the deviation of the target position of the first drive shaft from a line connecting the target positions of the second and third drive shafts is obtained, the first drive shaft being disposed at a position of the ram other than the ends of the ram while the second and third drive shafts being positioned at the ends of the ram, and an output signal indicative of abnormality is released if the deviation exceeds a preset allowable value.

According to the seventh aspect of the invention, when calculating, on a drive shaft basis, a target position of the movable die (i.e., a target closest distance between the movable die and the fixed die) necessary for attaining a target bend angle which has been input, the deviation of the target position of the first drive shaft from a line which connects the target positions of the second and third drive shafts is obtained. Herein, the first drive shaft is disposed at a position of the ram other than the ends of the ram, while the second and third drive shafts are positioned at the ends of the ram. If this deviation exceeds a preset allowable value, an output signal is released indicating that the calculated values are abnormal. With this method, even if the bending machine has three or more ram drive shafts and is designed to carry out inclination adjustment and crowning, whether a calculated, target closest distance between the movable die and the fixed die at each shaft-load imposed point is correct can be determined by attaining the deviation of each drive shaft from the reference shafts (i.e., the drive shafts positioned at the ends of the ram), during the arithmetic operation performed prior to actual bending operation. This makes it possible to prevent damage to the machine due to the occurrence of an error in bending operation.

The fourth object can be accomplished by a bending method for a bending machine according to an eighth aspect of the invention. This bending method is for use in a bending machine which bends a sheet-like workpiece by the cooperative movement of a movable die and a fixed die, the movable die being supported by a ram having three or more drive shafts, while the fixed die being supported in an opposing relationship with the movable die by a table both ends of which are secured, the bending method being characterized in that data on the present position of each drive shaft are successively taken in during the operation of the ram, and the deviation of the present position of the first drive shaft from a line connecting the present positions of the second and third drive shafts is obtained, the first drive shaft being disposed at a position of the ram other than the ends of the ram while the second and third drive shafts being positioned at the ends of the ram, and an output signal indicative of abnormality is released if the deviation exceeds a preset allowable value.

According to the eighth aspect, data on the present position of each drive shaft are taken in during the movement of the ram in actual bending operation. Based on the data of the present positions thus taken in, the deviation of the present position of the first drive shaft from a line connecting the present positions of the second and third drive shafts is obtained. Herein, the first drive shaft is disposed at a position of the ram other than the ends of the ram while the second and third drive shafts are positioned at the ends of the ram. If this deviation exceeds a preset allowable value, an output signal is released, informing that an error has occurred. With this method, even if the bending machine has three or more ram drive shafts and is designed to carry out inclination adjustment and crowning, whether an error has occurred in the position of each drive shaft can be confirmed by attaining the deviation of each drive shaft from the reference drive shafts positioned at the ends of the ram, during the movement of the ram. This makes it possible to prevent damage to the machine due to the occurrence of an error in bending operation.

According to a ninth aspect of the invention, there is provided a bending apparatus for use in a bending machine which bends a sheet-like workpiece by the cooperative movement of a movable die and a fixed die, the movable die being supported by a ram having three or more drive shafts, while the fixed die being supported in an opposing relationship with the movable die by a table both ends of which are secured, the bending apparatus comprising:

(a) input means for inputting desired bending process data;

(b) target position calculating means for calculating a target position of each drive shaft according to the bending process data input by the input means;

(c) comparison judgment means for comparing the target position of the first drive shaft with a line connecting the target positions of the second and third drive shafts, the target positions being calculated by the target position calculating means, the first drive shaft being disposed at a position of the ram other than the ends of the ram while the second and third drive shafts being disposed at the ends of the ram, and for judging whether or not the deviation of the target position of the first drive shaft from the connecting line exceeds a preset allowable value; and (d) informing means for releasing an output signal indicative of abnormality if the comparison judgement means judges that the deviation exceeds the preset allowable value.

The apparatus according to the ninth aspect implements the bending method having the seventh feature. In this apparatus, when calculating, by the target position calculating means, a target position of each drive shaft in order to attain a target bend angle input by the input means, the target position of the first drive shaft is compared with a line connecting the target positions of the second and third drive shafts. Herein, the first drive shaft is disposed at a position of the ram other than the ends of the ram while the second and third drive shafts are disposed at the ends of the ram. If the deviation of the target position of the first drive shaft from the connecting line is found to exceed a preset allowable value, an output signal is released from the informing means, indicating that the calculated values are abnormal. Like the method having the seventh feature, this method is capable of confirming if there occurs an error in calculating a target closest distance between the movable die and the fixed die in the arithmetic operation before performing actual bending operation. Accordingly, damage to the machine due to the occurrence of abnormality in bending operation can be prevented.

According to the ninth aspect, the comparison judgment means also may compare the positions of the drive shafts disposed at the ends of the ram to obtain the difference between them and judges whether this difference exceeds a preset allowable value. Further, it may compare the positions of two adjacent drive shafts to obtain the difference between them and judges whether each difference exceeds a preset allowable value. With this arrangement, abnormality detection can be performed with higher accuracy.

According to a tenth aspect of the invention, there is provide a bending apparatus for use in a bending machine which bends a sheet-like workpiece by the cooperative movement of a movable die and a fixed die, the movable die being supported by a ram having three or more drive shafts, while the fixed die being supported in an opposing relationship with the movable die by a table both ends of which are secured, the bending apparatus comprising:

(a) input means for inputting desired bending process data;

(b) ram driving means for driving the ram by independently controlling each drive shaft according to the bending process data input by the input means;

(c) position detecting means for detecting the present position of each drive shaft during the operation of the ram driven by the ram driving means;

(d) comparison judgment means for comparing the present position of the first drive shaft with a line connecting the present positions of the second and third drive shafts, the present positions being detected by the position detecting means, the first drive shaft being disposed at a position of the ram other than the ends of the ram while the second and third drive shafts being disposed at the ends of the ram, and for judging whether or not the deviation of the present position of the first drive shaft from the connecting line exceeds a preset allowable value; and (e) informing means for releasing an output signal indicative of abnormality if the comparison judgement means judges that the deviation exceeds the preset allowable value.

The bending apparatus according to the tenth aspect implements the bending method having the eighth feature. In this apparatus, while the ram is moved by the ram driving means according to bending process data input by the input means, the present position of each drive shaft is detected by the position detecting means. Based on the present positions thus detected, the comparison judgement means compares the present position of the first drive shaft with a line connecting the present positions of the second and third drive shafts. Herein, the first drive shaft is disposed at a position of the ram other than the ends of the ram while the second and third drive shafts are disposed at the ends of the ram. If the deviation of the present position of the first drive shaft from the connecting line is found to exceed a preset allowable value, an output signal is released from the informing means, indicating occurrence of an error. Like the method having the eighth feature, this method is capable of determining if there occurs an error in the positions of the drive shafts during the movement of the ram. Thus, damage to the machine due to the occurrence of an error in bending operation can be prevented.

According to the tenth aspect, the comparison judgment means also may compare the present positions of the drive shafts disposed at the ends of the ram to obtain the difference between them and judges whether this difference exceeds a preset allowable value. Further, it compares the present positions of two adjacent drive shafts to obtain the difference between them and judges whether each difference exceeds a preset allowable value. With this arrangement, highly reliable error detection can be performed.

BEST MODE FOR CARRYING OUT THE INVENTION

Figure 1:
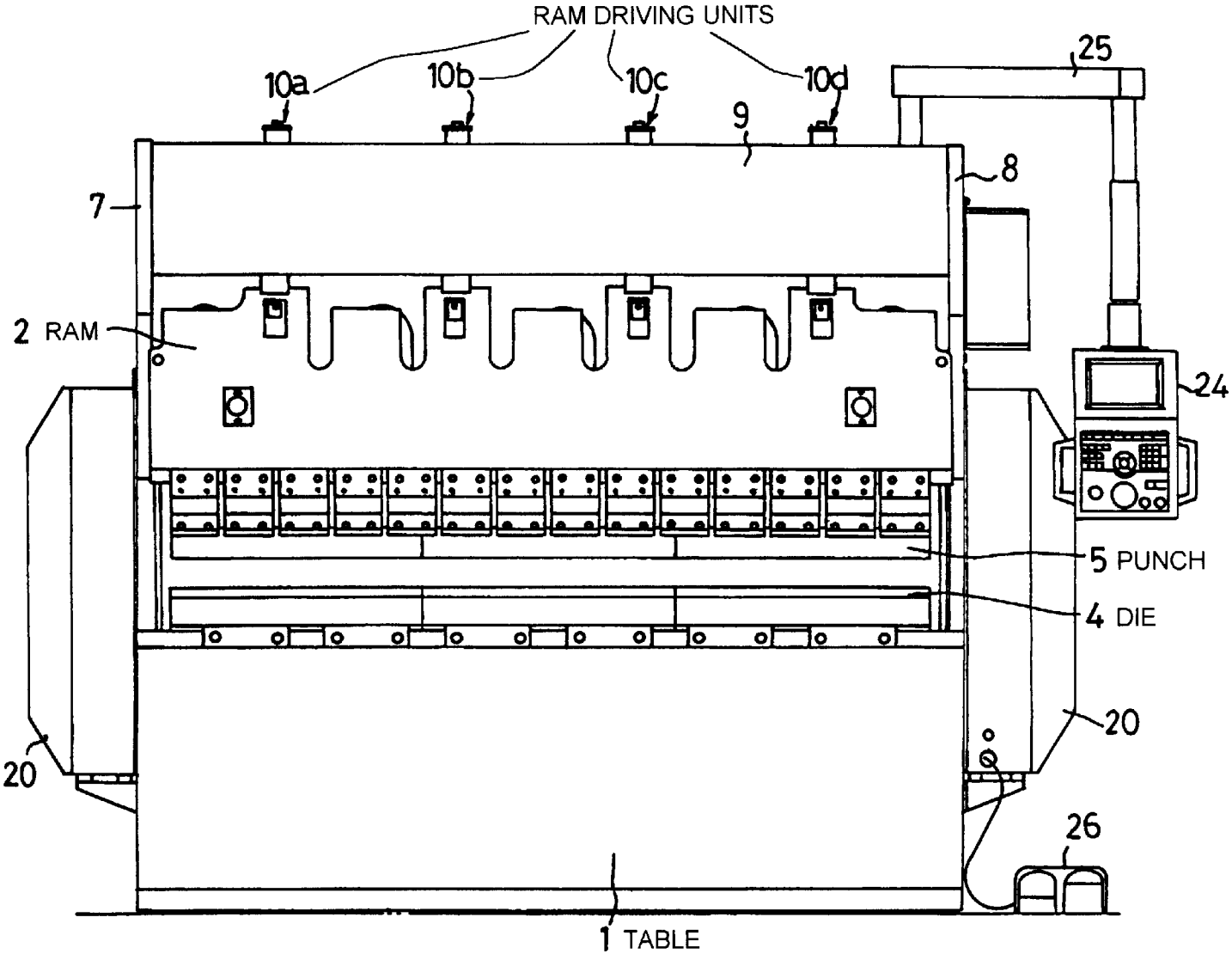
FIG. 1 is a front view of a press brake according to an embodiment of the invention.

Referring now to the drawings, there will be described bending methods and bending apparatus for a bending machine which embody the present invention.

Figure 2:
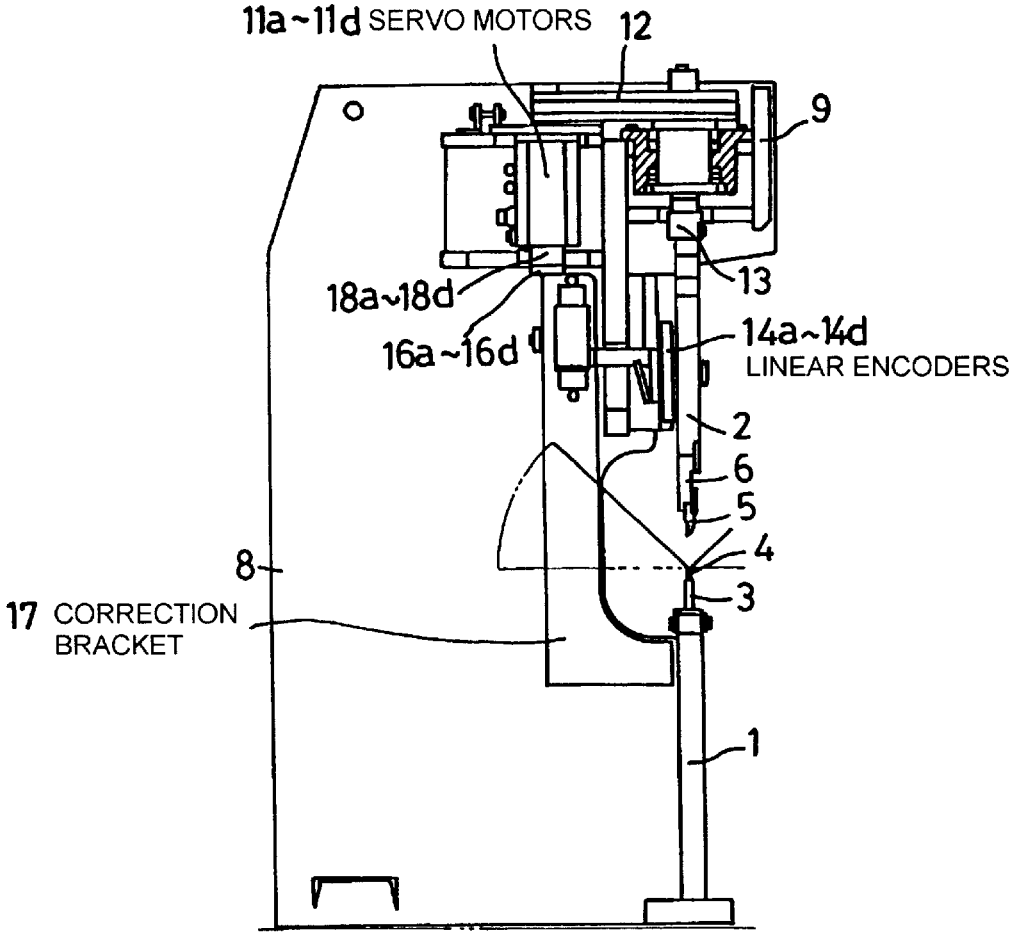
FIG. 2 is a side view of the press brake according to the embodiment.
Figure 3:
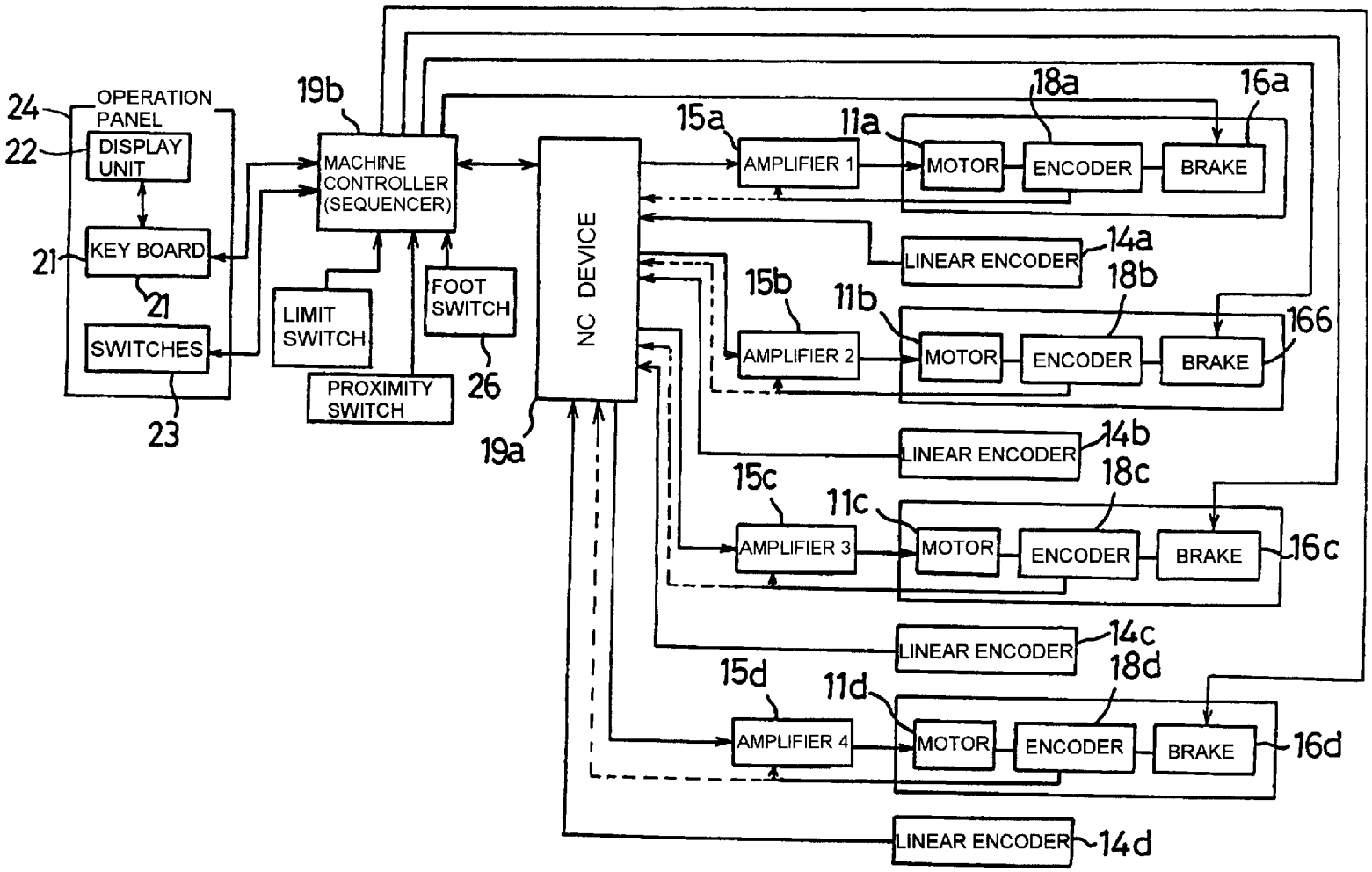
FIG. 3 is a block diagram showing the structure of the control system of the press brake according to the embodiment.

(I) Ram control accommodating to the deformation of the machine caused by the load imposed thereon:

FIGS. 1 and 2 are a front view and side view, respectively, of a press brake constructed according to one embodiment of the invention. FIG. 3 is a block diagram showing the structure of a control system incorporated in the press brake of this embodiment.

The press brake of the present embodiment comprises a fixed table 1 and a ram 2 which is in an opposing relation with the table 1 and driven so as to rise and lower. A die (lower die) 4 having a V-shaped groove is supported on the top of the table 1 by means of a die holder 3, while a punch (upper die) 5 is attached to the underside of the ram 2 by a punch holder 6 so as to face the die 4.

A pair of side frames 7, 8 are disposed on the respective sides of the table 1 in an integral fashion and a support frame 9 is disposed so as to connect the respective upper ends of the side frames 7, 8. The support frame 9 has a plurality of ram driving units (four units in this embodiment) 10*a* to 10*d* attached thereto. The ram 2 is connected to the respective lower ends of the ram driving units 10*a* to 10*d* so as to be rockable. The ram 2 is raised or lowered by the operation of the ram driving units 10*a* to 10*d*, thereby bending a workpiece inserted between the punch 5 and the die 4.

AC servo motors 11*a* to 11*d* are disposed behind the ram driving units 10*a* to 10*d* as their driving sources. Their driving forces are transmitted to ball screws 13 coupled to the ram 2 through timing belts 12. The ball screws 13 convert the rotary driving forces into vertically working forces which are then imposed on the workpiece as pressing force.

The position of the ram 2 in a vertical direction is detected by linear encoders (incremental encoders) 14*a* to 14*d* which are disposed at the positions corresponding to the positions of the drive shafts of the ram driving units 10*a* to 10*d*. The detection data of these encoders are input to an NC device 19*a*. According to the vertical position of the ram 2 at the positions (herein referred to as "shaft-load imposed points") corresponding to the position of the drive shafts, the servo motors 11*a* to 11*d* are feed-back controlled through servo amplifiers 15*a* to 15*d* and brakes 16*a* to 16*d* attached to the motor shafts of the servo motors 11*a* to 11*d* are feed-back controlled as well. The linear encoders 14*a* to 14*d* are supported by a correction bracket 17 composed of two side plates positioned beside the side frames 7, 8 and a beam for connecting the right and left side plates. By virtue of this arrangement, the linear encoders 14*a* to 14*d* are unaffected by the deformation of the side frames 7, 8 due to changes in load and the absolute position of the ram 2 at each shaft-load imposed point can be measured. It should be noted that encoders (absolute encoders) 18*a* to 18*d* are attached to the motor shafts of the servo motors 11*a* to 11*d*, in order to detect the respective present positions of the servo motors 11*a* to 11*d*. With the detection data of the encoders 18*a* to 18*d*, the servo amplifiers 15*a* to 15*d* are controlled.

A control unit 20, which includes the NC device 19*a* for controlling the ram driving units 10*a* to 10*d* and a machine controller (sequencer) 19*b*, is attached to the side of a main body frame of the press brake. An operation panel 24, which includes a key board 21 for inputting bending process data etc., a display unit 22 for displaying various data and switches 23, is suspended from the support frame 9 through a turnable arm 25. There is also provided a foot switch 26 operable by foot on the lower side of the main body frame.

In the press brake having the above-described structure, a target closest distance between the punch 5 and die 4 at every shaft-load imposed point is arithmetically calculated for bending the workpiece to a target angle, according to bending process data input through the operation panel 24. According to the result of this arithmetic operation, a target lower limit for the ram 2 is calculated. The drive shafts are simultaneously driven by the servo motors 11*a* to 11*d* so as to make the punch 5 and the die 4 close to or away from each other, thereby positioning the ram 2 at the target position. Whether the ram 2 has reached its target position is monitored and the ram 2 is controlled on a shaft-load imposed point basis, using a feed back signal representative of the position of the ram 2 at each shaft-load imposed point.

There will be concretely described an arithmetic operation for executing the above control.

Figure 4:
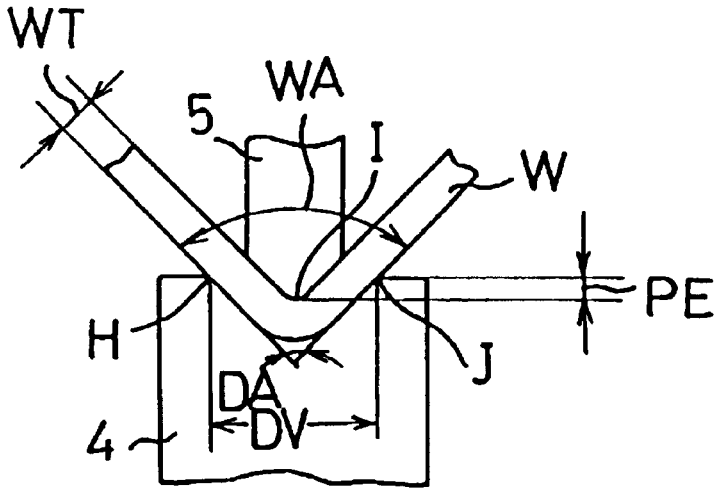
FIG. 4 is a schematic diagram showing the geometrical relationship between a die, a workpiece and a punch.

In bending a sheet-like workpiece W as shown in FIG. 4 (this bending is generally called V-bending (air bending)), the bend angle of a finished product (hereinafter called "finished bend angle") WA is specified by the positional relationship between the points H, I and J. The points H and J are determined by the die 4 and the punch 5, while the point I is determined by the formability of the workpiece W and finished bend angle WA. Herein, the distance of a line segment (the upper end of the die 4) which connects the point H and the point J from the point I (the tip of the punch 5) is represented by a punch penetration amount PE. For uniformly bending the workpiece W to the target bend angle WA, the punch penetration amount PE should be a proper value and the lower limit position of the ram 2 should be so controlled as to obtain the same value at all the shaft-load imposed points of the workpiece W, which points are aligned in a longitudinal direction. This bending is performed on the assumption that there are no variations in the thickness WT of the workpiece as well as in the V-groove width DV of the die 4.

As explained below, the factors for determining the punch penetration amount PE are roughly classified into formability factors and the mechanical factors of the main body of the press brake.

(1) Formability Factors (1-i) Die Conditions

Figure 5:
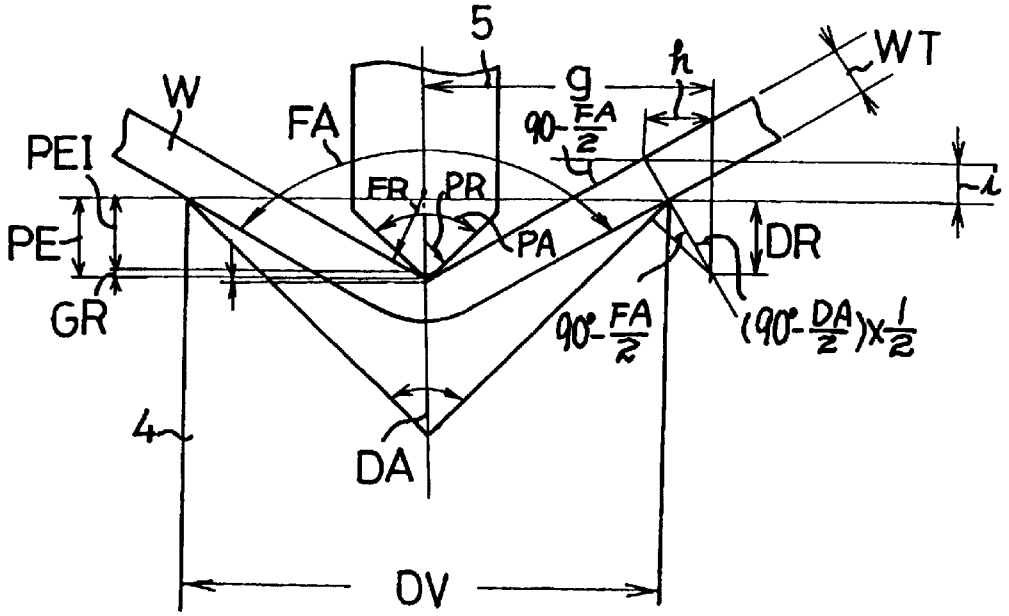
FIG. 5 is a diagram showing the geometrical relationship between the die, the workpiece and the punch in an air bending process.

These conditions are the respective dimensions of the sections of the punch 5 and the die 4 including: the radius PR of the tip of the punch; the width of the V-groove of the die DV; the angle of the V-groove of the die DA; the radius of the shoulder of the V-groove of the die DR; and others (see FIG. 5).

(1-ii) Material Conditions

These conditions are the properties of the workpiece including: material; thickness WT; n-value; and others.

(1-iii) Bending Load

This is a factor for determining how much the tip of the punch penetrates into the workpiece and how much the machine body is deformed. This factor is obtained from finished bend angle WA, die conditions and material conditions.

(1-iv) Others holding time; forming speed; etc.

(2) Mechanical Factors (2-i) The Change of the Load Imposed on the Ram and the Table the change of the compression of the ram 2 and the table 1; the deflection of the table 1; etc.

(2-ii) Others the change of the bottom dead center owing to temperature change; heat deformation; etc.

Figure 6:
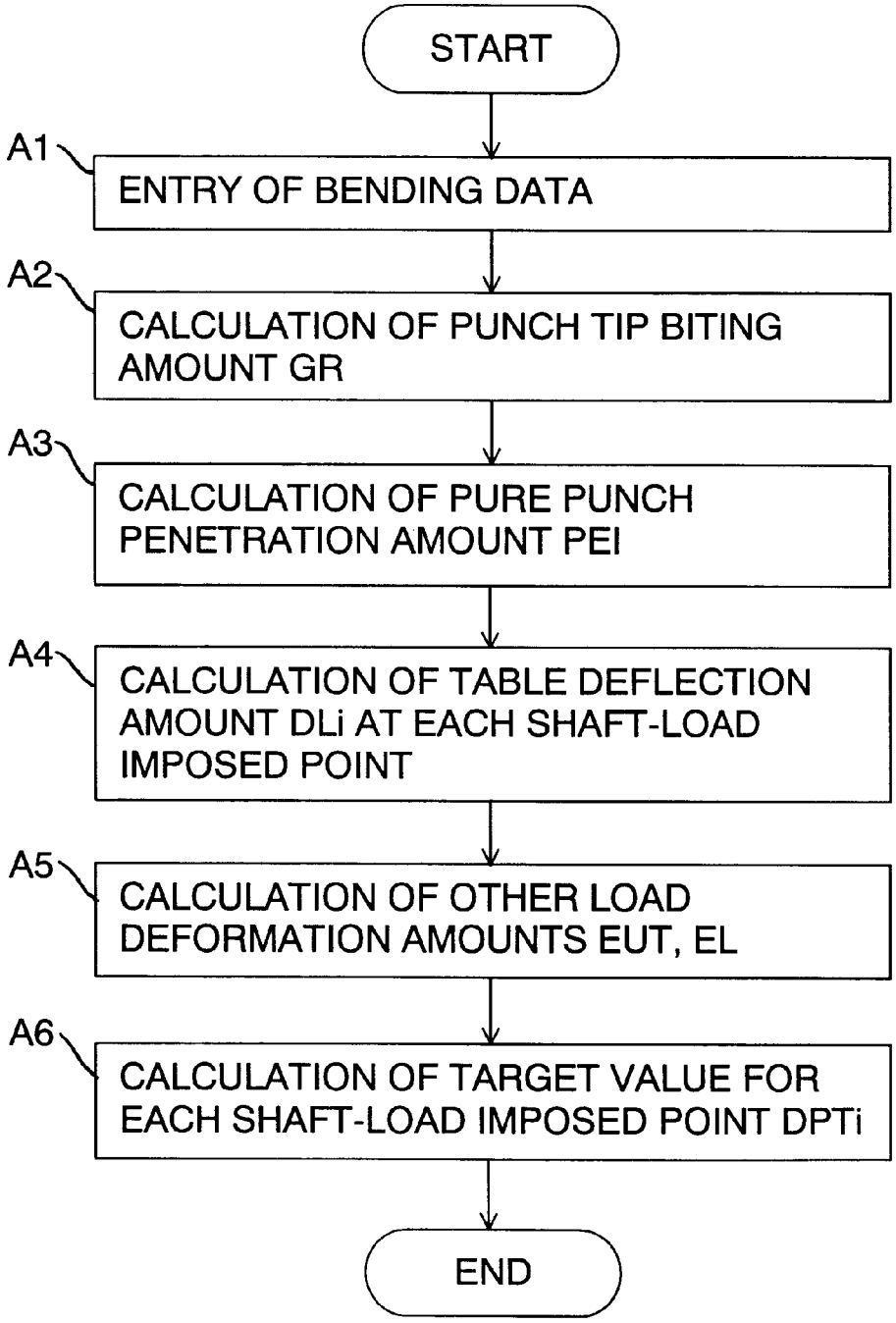
FIG. 6 is a flow chart of a process for setting a bottom dead center for each drive shaft.
Figure 7:
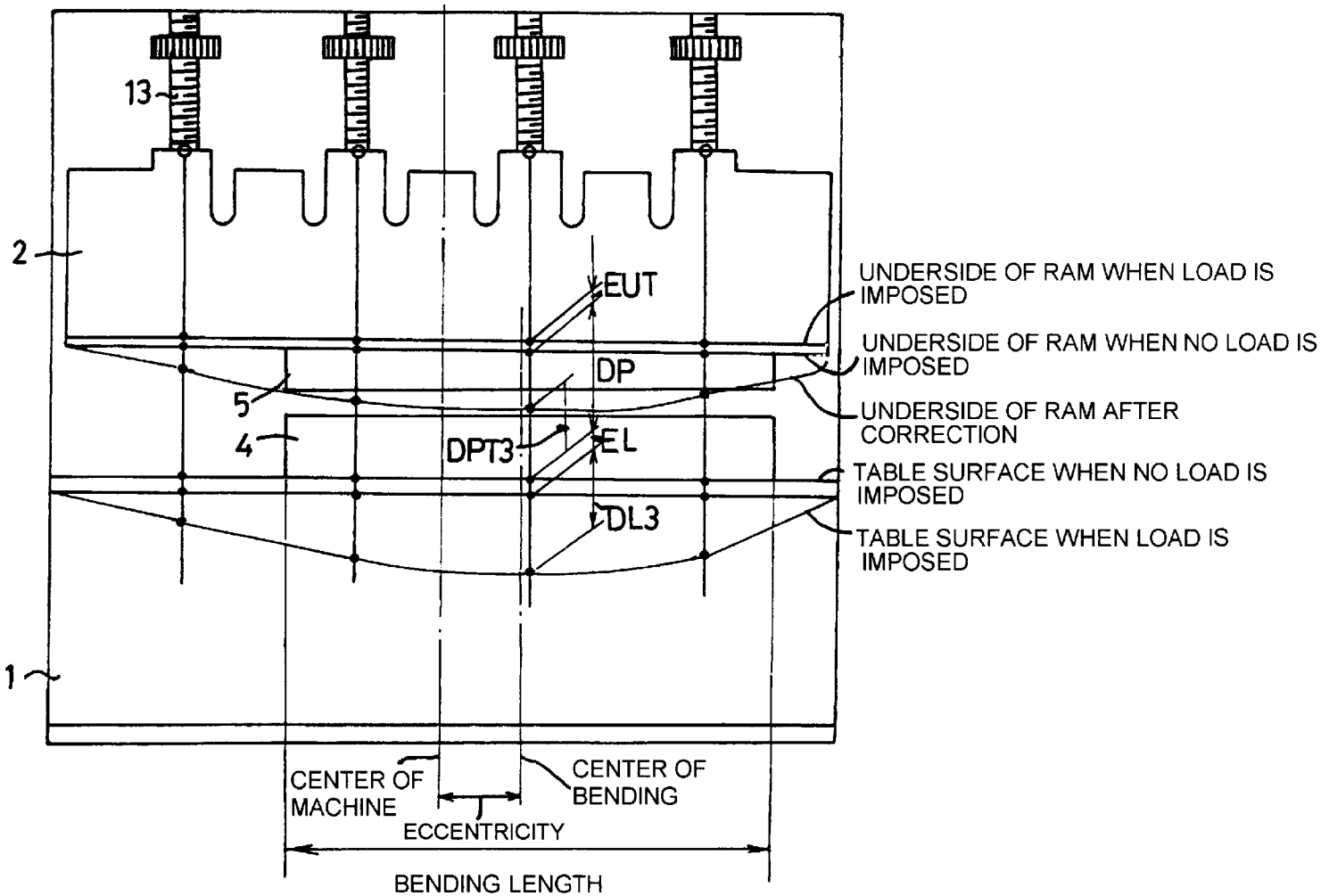
FIG. 7 is a diagram showing the deformed conditions of members.

Next, reference is made to the flow chart of FIG. 6 and the explanatory diagram of FIG. 7 for describing, step by step, an arithmetic operation for obtaining a target position of each shaft-load imposed point of the ram 2.

STEP A1: Workpiece processing conditions are input through the operation panel 24 as bending process data. These workpiece processing conditions are data associated with the formability factors including workpiece material MAT, workpiece thickness WT, finished bend angle WA, springback angle SB, inner bending radius during operation FR, punch tip radius PR, die V-groove width DV, die V-groove angle DA, and die V-shoulder radius DR. Other processing conditions are input as the bending process data, but they are not taken into consideration herein.

STEPS A2 to A3: For obtaining the punch penetration amount PE determined by the formability factors, a punch tip biting amount GR (the punch tip penetrates into the workpiece due to the plasticity of the workpiece) is first obtained. The punch tip biting amount GR is unitarily obtained from the following equation according to workpiece material MAT, workpiece thickness WT, finished bend angle WA, punch tip radius PR, and die V-groove width DV.

$$GR=f(MAT, WT, WA, PR, DV)$$

Note that a function f is determined beforehand experimentally or by simulation.

The bend angle FA during operation is represented by FA=WA−SB and therefore a pure punch penetration amount PEI (see FIG. 5: the amount PEI is the penetration of the punch purely required for forming a bend) is given by the following equation.

$$PEI=(g-h)\times\tan(90°-FA/2)-i-j$$

where $g=DV/2+DR\times\tan(90°-DA/2)/2$ $h=(DR+WT)\times\sin(90°-FA/2)$ $i=(DR+WT)\times\cos(90°-FA/2)-DR$ $j=FR\times(1/\cos(90°-FA/2)-1)$ Therefore, the punch penetration amount PE depending on the formability factors is calculated from:

$$PE=PEI+GR$$

STEPS A4 to A5: For obtaining the punch penetration amount PE including mechanical factors, the condition of deformation in each area is modeled as shown in FIG. 7 and a lower limit position is obtained in the following way, taking into account the mechanical deformation when load is exerted. Concretely, data on punch height PH, die height DH, workpiece bending length WL and workpiece bending position WPP are input through the operation panel 24 which serves as an input means, in addition to the above-mentioned formability factors. According to the data, the displacement EUT of the ram 2 due to load, the displacement EL of the table 1 due to load and a deflection amount DLi (i=1, 2, 3, 4) at each shaft-load imposed point of the table 1 are obtained. Of these mechanical factors, the displacement EUT of the ram 2 and the displacement EL of the table 1 due to load are particularly important and the effects of other factors are neglected herein.

A table deflection amount DLi is obtained by multiplying a bending deflection amount YBi and a shearing deflection amount YSi at each shaft-load imposed point by a differential coefficient DLCOR experimentally obtained, these deflection amounts being obtained when equally distributed load is imposed on the end supporting beam.

The bending deflection amount YBi and shearing deflection amount YSi are obtained in the following way.

Figure 8:
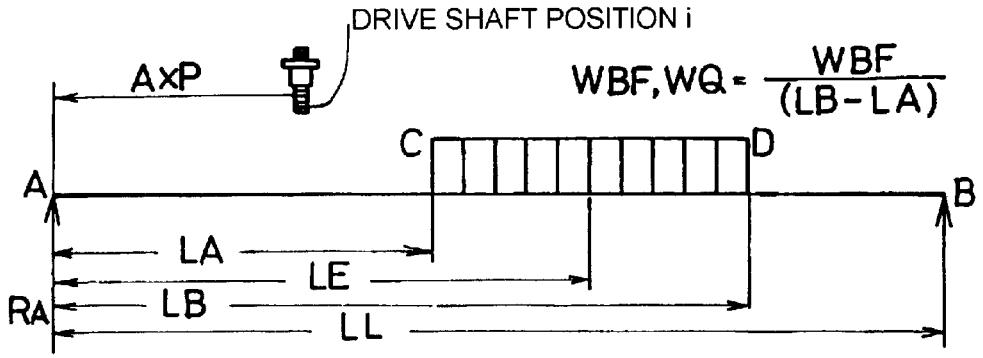
FIG. 8 is a diagram for explaining an equation used for calculating the deflection of a table.

Suppose that the distance of a shaft-load imposed point from the point A is represented by AXP as shown in FIG. 8.

(1) Where the shaft-load imposed point is positioned between the point A and the point C ($0 \leqq AXP \leqq LA$):

$$YB=-(RA/6\times AXP^3+C1\times AXP)/(E\times I)$$

$$YS=K\times RA\times AXP/(G\times A)$$

(2) Where the shaft-load imposed point is positioned between the point C and the point D ($LA \leqq AXP < LB$):

$$YB=-(RA/6\times AXP^3-WQ/24\times(AXP-LA)^4+C1\times AXP)/(E\times I)\ YS=(RA\times AXP-WQ/2\times(AXP-LA)^2)\times K/(G\times A)$$

(3) Where the shaft-load imposed point is positioned between the point D and the point B ($LB \leqq AXP < LL$):

$$YB=-(RA/6\times AXP^3-WBF/6\times(AXP-LE)^3+C5\times AXP+C6)/(E\times I)$$

$$YS=(RA\times AXP-WBF\times(AXP-LE))\times K/(G\times A)$$

Accordingly, the deflection amount DLi at the shaft-load imposed point i, which is experimentally obtained, is calculated from the following equation.

$$DLi=(YB+YS)\times DLCOR$$

where YB is a bending deflection amount; YS is a shearing deflection amount; E is elastic modulus in a vertical direction; G is elastic modulus in a lateral direction; I is geometrical moment of inertia; A is cross sectional area: RA is a reaction force at the point A; WQ is load per unit length; WBF is total load; C1, C5 and C6 are constants; and K is a shearing stress rate.

C1, C5 and C6 are given by the following equations.

$$C5=(WBF/2\times(LB-LE)^2-WBF/6\times(LB-LA)^2+ZZ/LB)\times LB/LL$$

$$C1=(ZZ+C5\times(LB-LL))/LB$$

$$C6=WBF/6\times(LL-LE)^3-RA/6\times LL^3-C5\times LL$$

It should be noted that $ZZ=WBF/24\times(LB-LA)^3-WBF/6\times(LB-LE)^3+WBF/6\times(LL-LE)^3-RA/6\times LL^3$.

The differential coefficient DLCOR of the displacement EUT of the ram 2, the displacement EL of the table 1 and the deflection of the table 1 can be readily obtained from an empirical formula which is unitarily determined by processing conditions given by experiments or simulations.

STEP A6: Thus, a target bottom dead center DPTi of each shaft-load imposed point of the ram 2 is calculated. In the case shown in FIG. 7, a target value DPT3 for the third shaft-load imposed point is described by the following equation.

$$DPT\ 3=PH+DH-PE-EUT-EL-DL3$$

Likewise, target values of the bottom dead centers of the first, second, fourth shaft-load points are arithmetically calculated.

After obtaining the target values of the bottom dead centers, each drive shaft for the ram 2 is driven according to its corresponding target value, so that the ram 2 is deformed and the workpiece is bent to the target bend angle WA throughout the length of the workpiece.

With the press brake of this embodiment, the configuration of a crown conforming to the deformation of the table can be automatically obtained by inputting bending process data so that the workpiece can be bent to a desired finished bend angle, not only in center bending but also in off-center bending.

(II) Ram control in which a crowning correction value and an inclination correction value are taken into account:

There will be explained a control unit that is incorporated in the press brake of the present embodiment, for controlling the ram taking a crowning correction value and an inclination correction value into account.

In the press brake of the present embodiment, a target value of the lower limit position of the ram 2 is calculated based on the bending process data input through the operation panel 24 as described earlier, and the ram 2 is monitored and controlled by controlling each drive shaft. Even though bending operation is thus performed by monitoring and controlling the position of the ram 2 on a drive shaft basis, the actual bend angle of the workpiece sometimes does not coincide with a desired target bend angle. This happens depending on the thickness and tensile strength of the workpiece or wear of the dies. Bearing such cases in mind, the press brake of this embodiment is designed to measure bend angle at the ends and center of a workpiece after it has undergone a bending process or trial bending and to calculate a correction value for the position of each shaft-load imposed point according to the difference between a measured bend angle and a desired target bend angle input by the input means, i.e., the operation panel 24.

Figure 9:
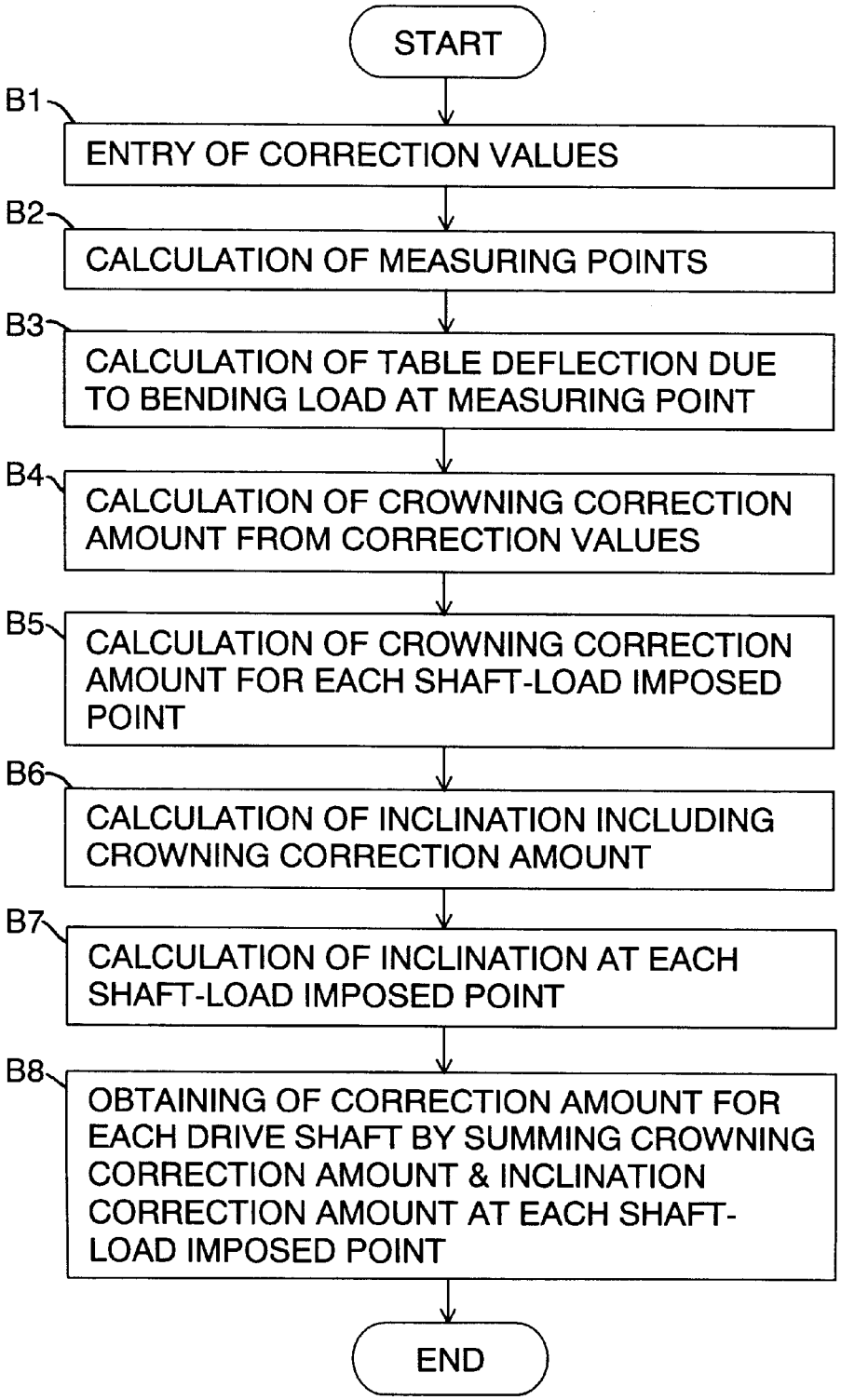
FIG. 9 is a flow of an arithmetic operation for correcting a bend angle.
Figure 10:
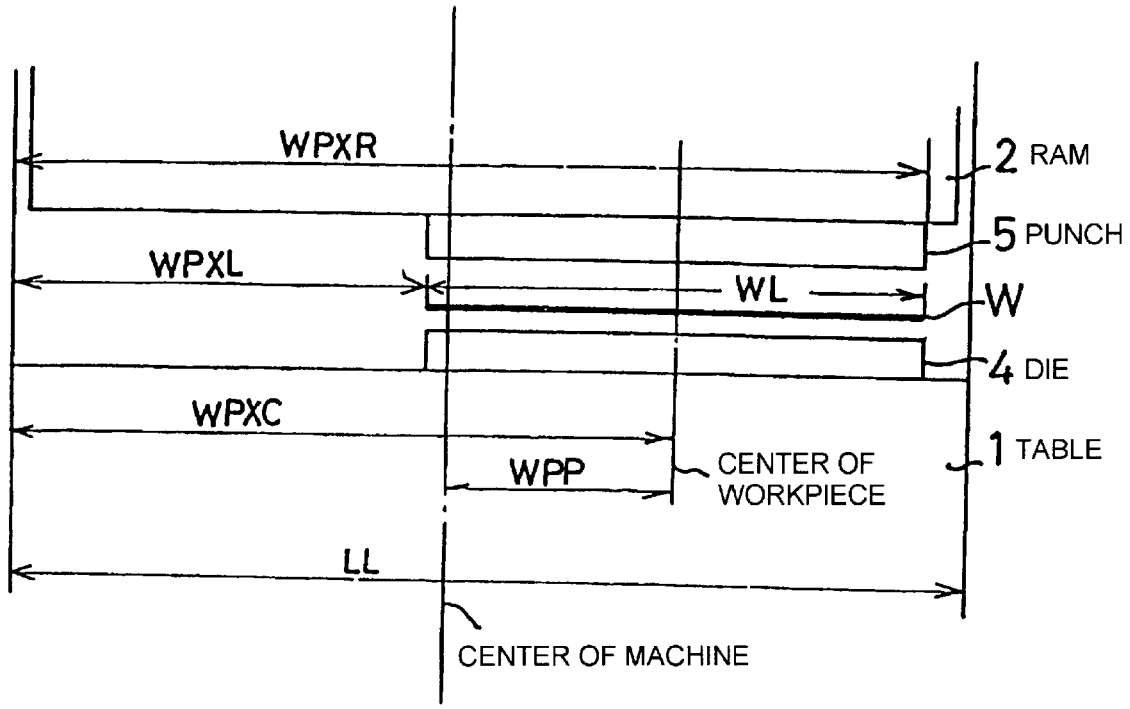
FIG. 10 is a diagram for explaining the content of an arithmetic operation for obtaining measuring points.

An arithmetic operation for bend angle correction will be described with reference to the flow chart of FIG. 9 and the explanatory diagrams of FIGS. 10 to 15.

STEP B1: The difference between the actual bend angle of the workpiece after bending operation and a target bend angle are obtained at three positions, that is, the ends and center of the workpiece. Correction values for the moving amounts of the drive shafts corresponding to these three positions are obtained from the respective differences and input through the operation panel 24.

STEP B2: Based on input data representative of workpiece bending length and a bending position, the positions of the measuring points are obtained by calculating the respective distances from the left end of the table 1 to the workpiece ends and to the workpiece center (see FIG. 10). Where the distance between the table supporting points is LL, the eccentricity of the bending position is WPP and the bending length of the workpiece is WL, the positions of these measuring points are calculated by the following equations.

(1) The center of the workpiece $$WPXC=LL/2+WPP$$

(2) The left end of the workpiece $$WPXL=WPXC-WL/2$$

(3) The right end of the workpiece $$WPXR=WPXC+WL/2$$

STEP B3: The deflection amount of the table at each measuring point is obtained based on the bending load BF which has been obtained at the time of the calculation of a target value (see FIG. 11). For example, a deflection amount CWXC of the table at the position corresponding to the center of the workpiece is obtained by the following calculation. A deflection amount YB due to bending moment at the center of the workpiece is described by $$YB=-(RA/6\times WPXC^3+C1\times WPXC)/(E\times I_Z).$$

A deflection amount YS due to shearing force at the center of the workpiece is described by $$YS=(RA\times WPXC-WQ/2\times(WPXC-LA)^2)\times K/(G\times A).$$

Therefore, the table deflection amount CWXC is given by $$CWXC=YB+YS$$

where WQ is bending load per unit length;

RA is a reaction force at the left end of the table;

$I_Z$ is a geometrical moment of inertia;

E is a vertical elastic coefficient;

G is a lateral elastic coefficient; and

K, A, C1 are other constants.

Similarly, a table deflection amount CWXL at the position corresponding to the left end of the workpiece and a table deflection amount CWXR at the position corresponding to the right end of the workpiece are obtained.

STEP B4: From the correction value data input in STEP B1, the difference CWPCH between the line connecting the correction value HSTL associated with the left end of the workpiece and the correction value HSTR associated with the right end of the workpiece and the correction value HSTC associated with the center of the workpiece is obtained, using the following equation (see FIG. 12).

$$CWPCH=HSTC-(WPXC-WPXL)\times(HSTR-HSTL)/(WPXR-WPXL)-HSTL$$

Figure 11:
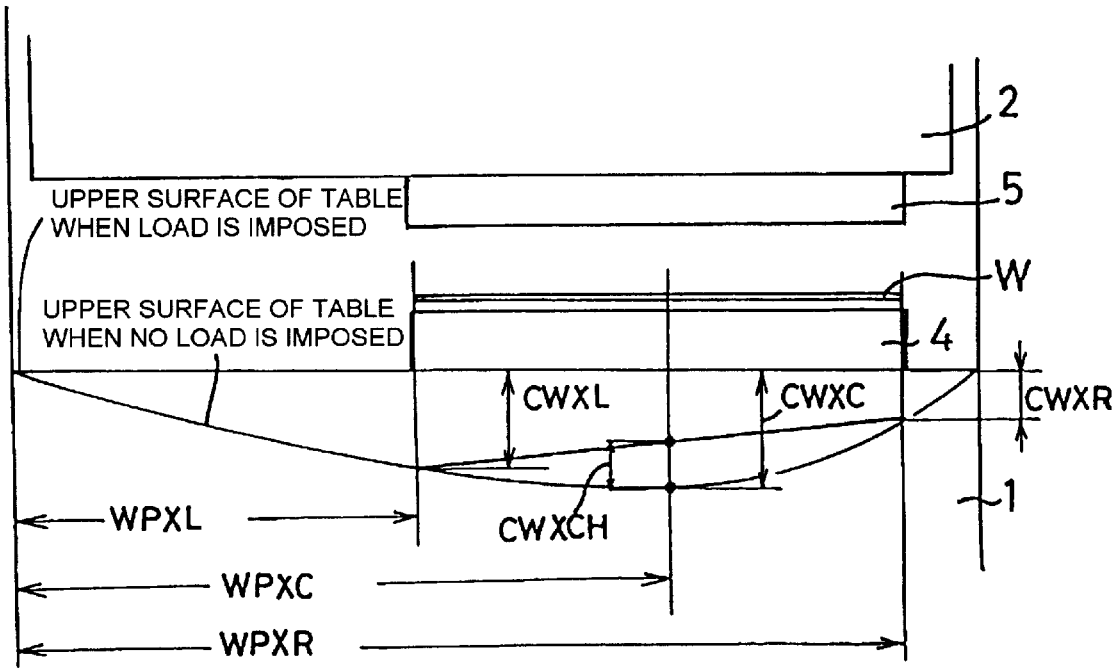
FIG. 11 is a diagram for explaining the content of an arithmetic operation for obtaining the deflection amount of the table.
Figure 12:
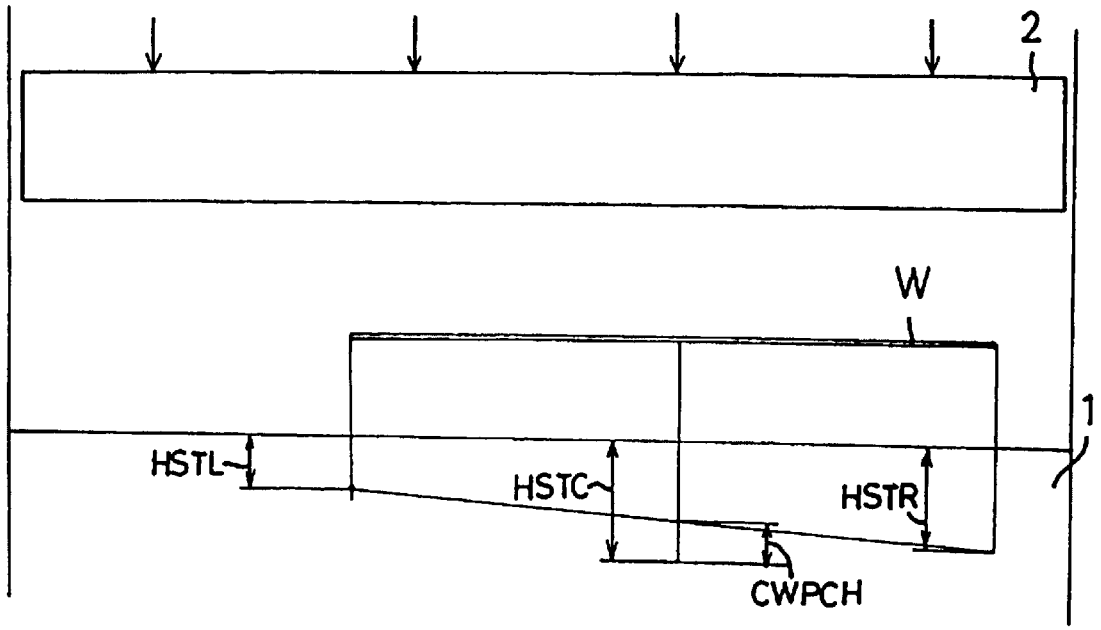
FIG. 12 is a diagram for explaining the content of an arithmetic operation for obtaining a crowning amount from correction values.
Figure 13:
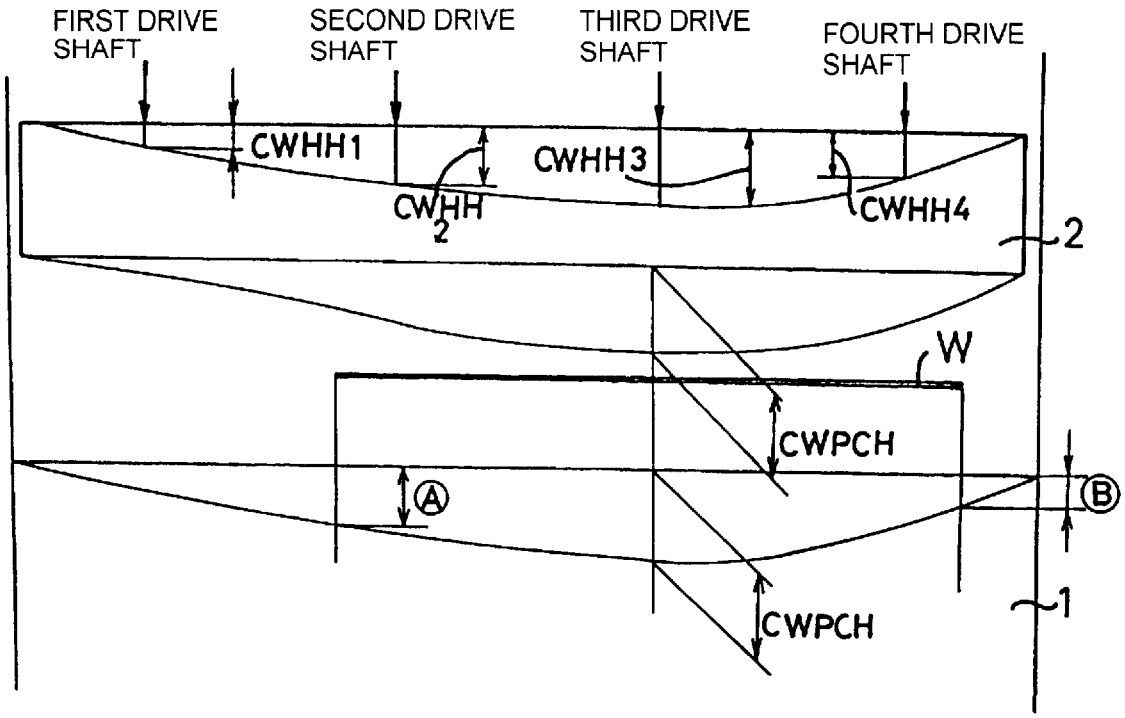
FIG. 13 is a diagram for explaining the content of an arithmetic operation for obtaining an crowning correction amount for each shaft-load imposed point.

From the table deflection amounts at the measuring points which have been calculated from the bending load, the difference CWXCH between the table deflection amounts CWXL, CWXR associated with the left and right ends of the workpiece and the table deflection amount CWXC at the center of the workpiece is obtained, according to the following equation (see FIG. 11).

$$CWXCH=CWXC-(WPXC-WPXL)\times(CWXR-CWXL)/(WPXR-WPXL)-CWXL$$

STEP B5: Based on the table deflection amounts due to the bending load at the center and shaft-load imposed points of the table, which have been calculated at the time of the calculation of the target position, the ratio between CWPCH and CWXCH obtained in STEP B4 is converted into a crowning correction value for each shaft-load imposed point (see FIG. 13). For instance, a crowning correction amount CWHH1 for the first shaft-load imposed point is represented by CWHH1=DL1×CWPCH/CWXCH−CWHHL where a table deflection amount due to the bending load at the first shaft-load imposed point is DL1.

Herein, CWHHL is a correction coefficient which indicates that a correction value is obtained on the basis of the measuring point corresponding to the left end of the workpiece and is calculated by the following equation.

$$CWHHL=CWXL\times CWPCH/CWXCH$$

Correction amounts associated with other drive shafts are obtained in the similar way. The generalized equation is as follows.

$$CWHHi=DLi\times CWPCH/CWXCH-CWHHL \qquad (i=1, 2, 3, 4)$$

STEP B6: A correction value associated with each end of the workpiece from which its corresponding crowning correction value has been subtracted is calculated by the following equations, thereby obtaining an inclination angle including the crowning correction amount (see FIG. 14).

$$CWHTL=HSTL-CWXL\times CWPCH/CWXCH$$

$$CWHTR=HDTR-CWXR\times CWPCH/CWXCH$$

Figure 14:
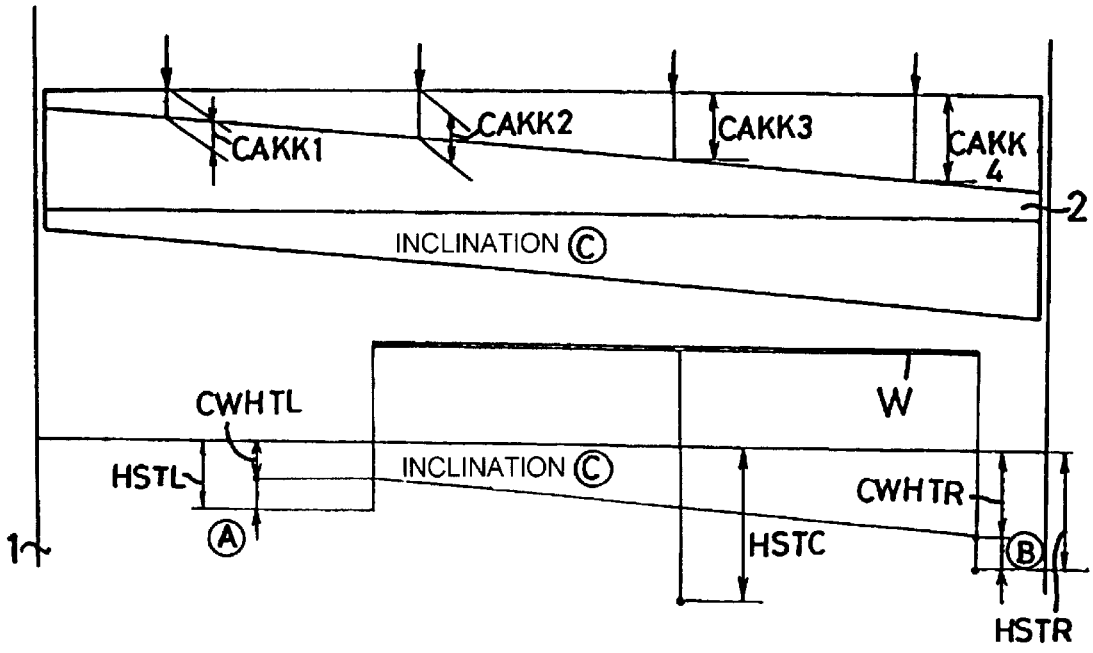
FIG. 14 is a diagram for explaining the content of an arithmetic operation for obtaining an inclination amount including a crowning correction amount and obtaining an inclination correction amount for each shaft-load imposed point.
Figure 15:
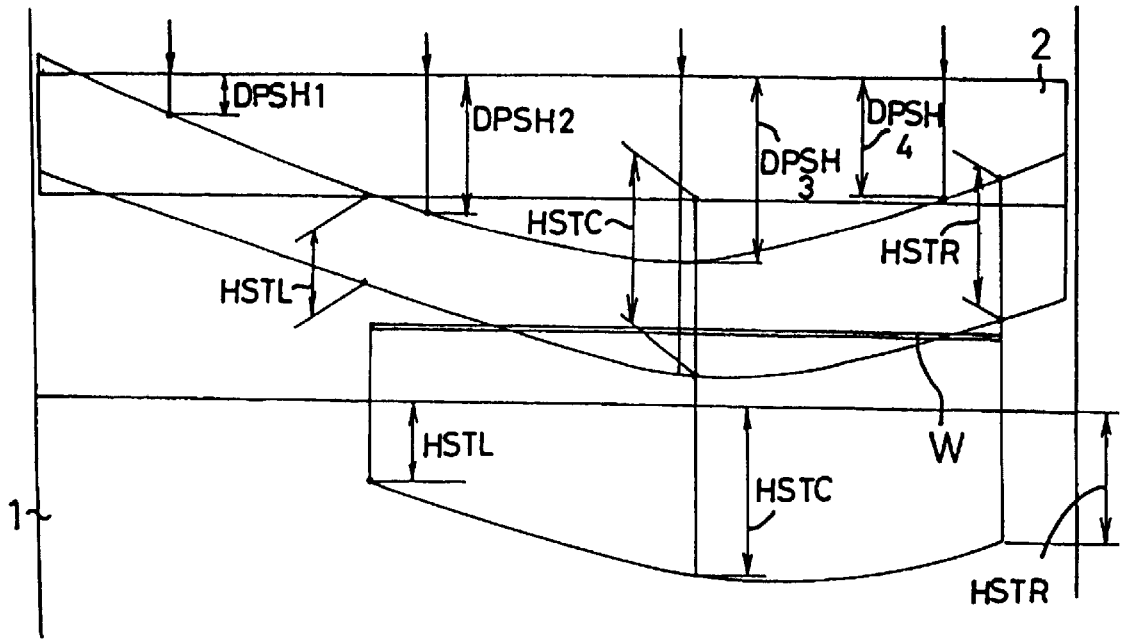
FIG. 15 is a diagram for explaining the content of an arithmetic operation for obtaining a correction amount for each shaft-load imposed point.

STEP B7: An inclination amount CAKKi for each shaft-load imposed point is obtained from the following equation based on the result of the arithmetic operation performed in STEP B6 (FIG. 14).

$$CAKKi=(APPi-APP1)\times(CWHTR-CWHTL)/(WPXR-WPXL)-CAKKL \qquad (i=1, 2, 3, 4)$$

CAKKL is a correction coefficient which indicates that a correction value is obtained on the basis of the measuring point corresponding to the left end of the workpiece and is calculated by the following equation.

$$CAKKL=(WPXL-APP1)\times(CWHTR-CWHTL)/(WPXR-WPXL)-CAKKL$$

In this way, an inclination correction amount for each shaft-load imposed point can be obtained.

STEP B8: To obtain a correction amount DPSHi for each shaft-load imposed point, the crowning correction amount obtained in STEP B5 and the inclination correction amount obtained in STEP B7 are summed and the correction amount HSTL for the position corresponding to the left end of the workpiece is added to the sum (see FIG. 15). This is described by the following equation.

$$DPSHi=HSTL+CWHHi+CAKKi \qquad (i=1, 2, 3, 4)$$

While a correction value for the moving amount of each drive shaft is input in this embodiment, the difference between a target bend angle and the actual bend angle may be input. This difference can be easily converted into data on the moving amount of each drive shaft, using bending process data.

For correction, measurement is made at the three points on the table which correspond to the right end, left end and center of the workpiece in the present embodiment. The correction may be carried out with four or more distinctly specified, measuring points. In this case, correction amounts are obtained similarly to the case where measurement is made at three points. Specifically, a crowning correction amount is obtained, by calculating the difference, in terms of correction amount, between the line which connects the points associated with the right and left ends of the workpiece and each measuring point positioned between these end points. An inclination amount is obtained from the correction amounts associated with the right and left ends and an overall angle correction amount from the correction amount associated with the left end.

Figure 16:
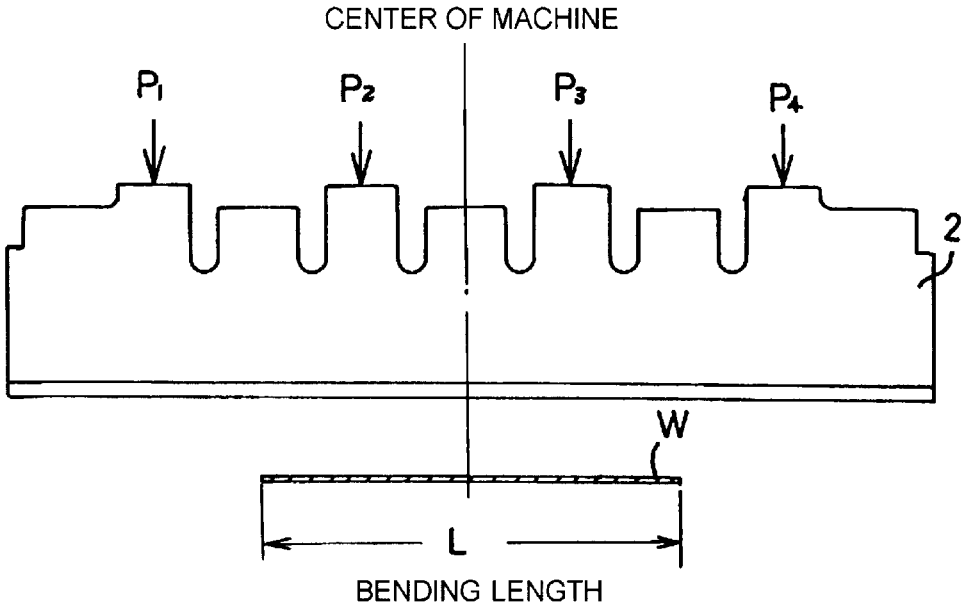
FIG. 16 is a diagram illustrating a case where a workpiece is bent at the center of a machine.
Figure 17:
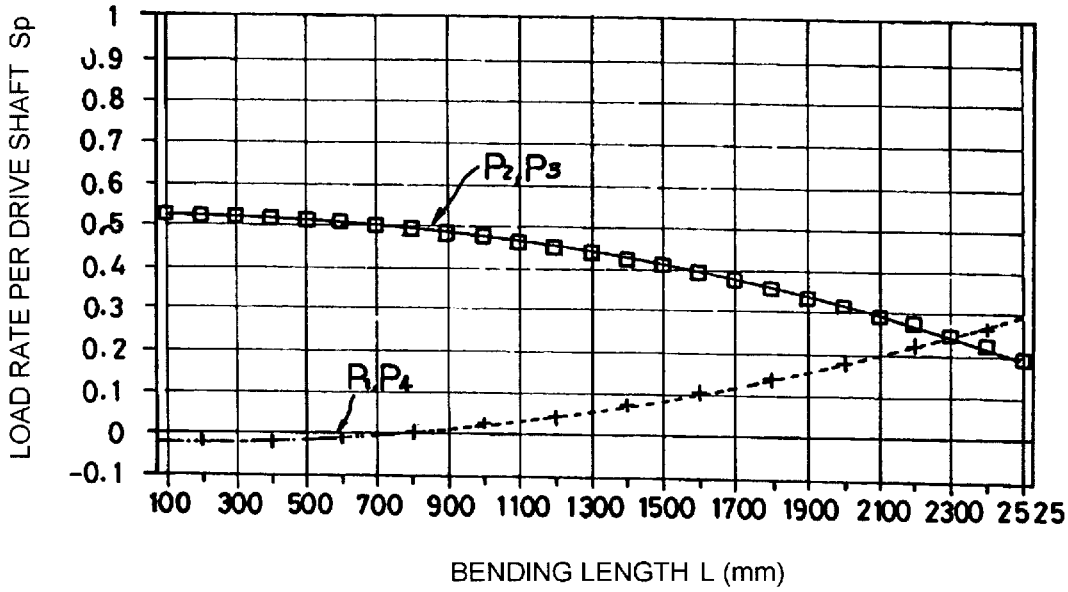
FIG. 17 is a graph showing the relationship between bending length and the rate of load exerted on a drive shaft.

(III) Ram control in which a limit value for pressing force generated by each drive shaft is taken into account:

In the press brake having the above-described structure, the ram 2 is driven by four drive shafts $P_1$, $P_2$, $P_3$ and $P_4$ in the manner diagrammatically shown in FIG. 16, when bending the workpiece W with a bending center being coincident with the center of the machine. Therefore, bending load exerted by each drive shaft varies as shown in FIG. 17, depending on the bending length L of the workpiece W. More specifically, if the bending length L is short, most of the bending load is exerted from the two central drive shafts $P_2$, $P_3$ and as the bending length L increases, bending load created by the drive shafts $P_1$ and $P_4$ positioned at the ends increases. If the bending length L is proximate to the length of the machine, substantially equal bending load is exerted by each drive shaft. The drive shafts are so arranged as to place load on the workpiece as described above. For example, the rate of load Sp created by each of the central drive shafts $P_2$ and $P_3$ is approximated to the following quadratic equation.

$$Sp=C1\times L^2+C2 \quad (1)$$

C1, C2=constants

Figure 18:
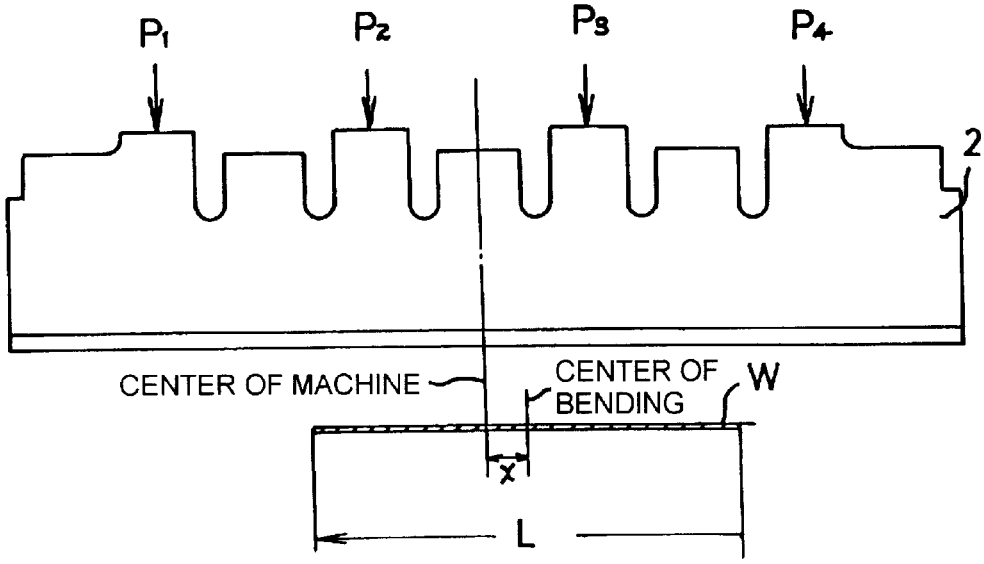
FIG. 18 is a diagram showing a case where off-center bending is performed.
Figure 19:
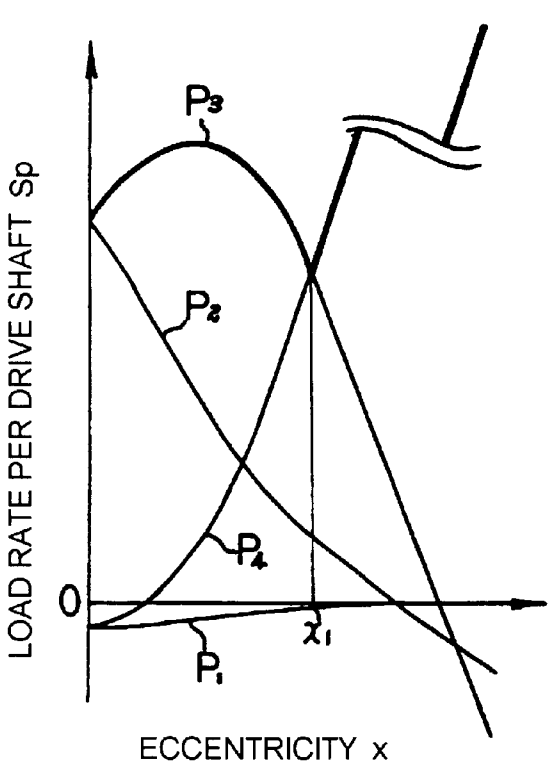
FIGS. 19(*a*), 19(*b*) and 19(*c*) are graphs each showing the relationship between eccentricity and the rate of load exerted on one drive shaft in off-center bending.
Figure 19:
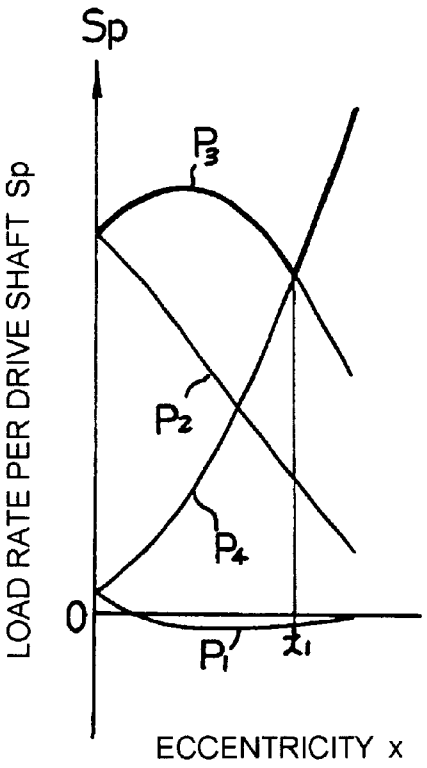
Figure 19:
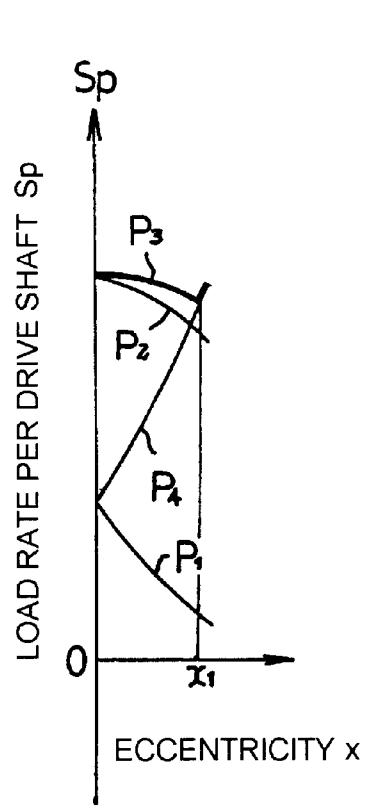

In the case of off-center bending in which the bending position of the workpiece is shifted from the center of the machine to the right or left by an eccentricity x, as shown in FIG. 18, the load exerted by each drive shaft varies as shown in FIGS. 19(*a*), 19(*b*) and 19(*c*), according to the bending length L and the eccentricity x. Regarding the drive shaft which creates the highest load, it is understood from FIG. 19 that if the bending length L is short (1,800 mm or less in the present embodiment), the drive shaft $P_3$ creates the highest load where the eccentricity x is in the range from 0 to the intersection point $x_1$, and that the drive shaft $P_4$ creates the highest load where the eccentricity x is in the region exceeding the intersection point $x_1$. If the bending length L is long to a certain extent (1,800 mm or more in the present embodiment), there are some cases the eccentricity x cannot be set to a large value, but the load exerted by each of the other drive shafts does not exceed the load exerted by the drive shaft $P_3$, irrespective of the eccentricity x.

Figure 20:
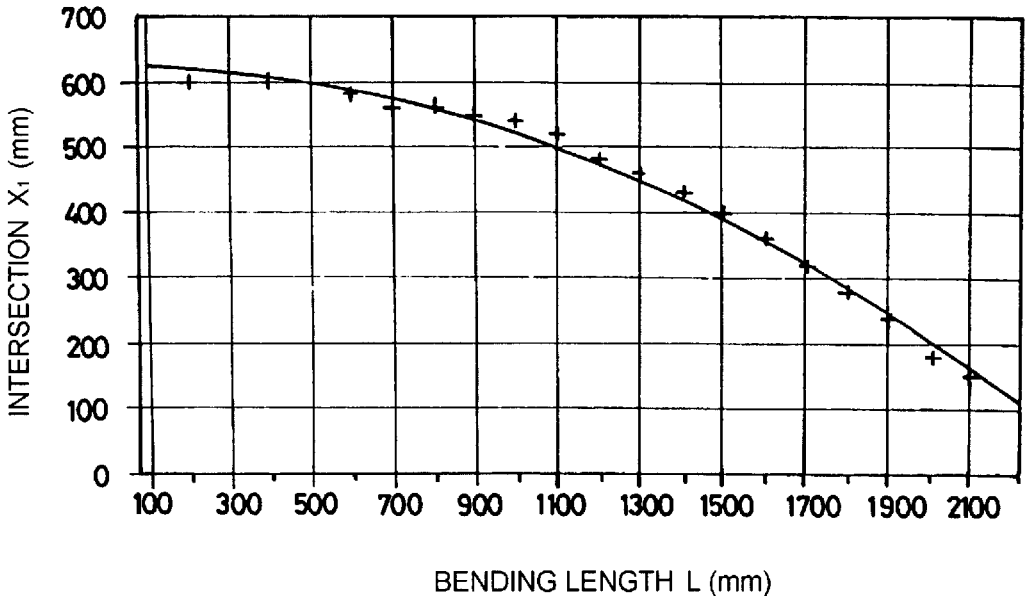
FIG. 20 is a graph showing the relationship between an intersection point and bending length.

The intersection point $x_1$ is approximated to the following quadratic equation relative to the bending length L (see FIG. 20).

$$x_1=C3\times L^2+C4 \quad (2)$$

Figure 21:
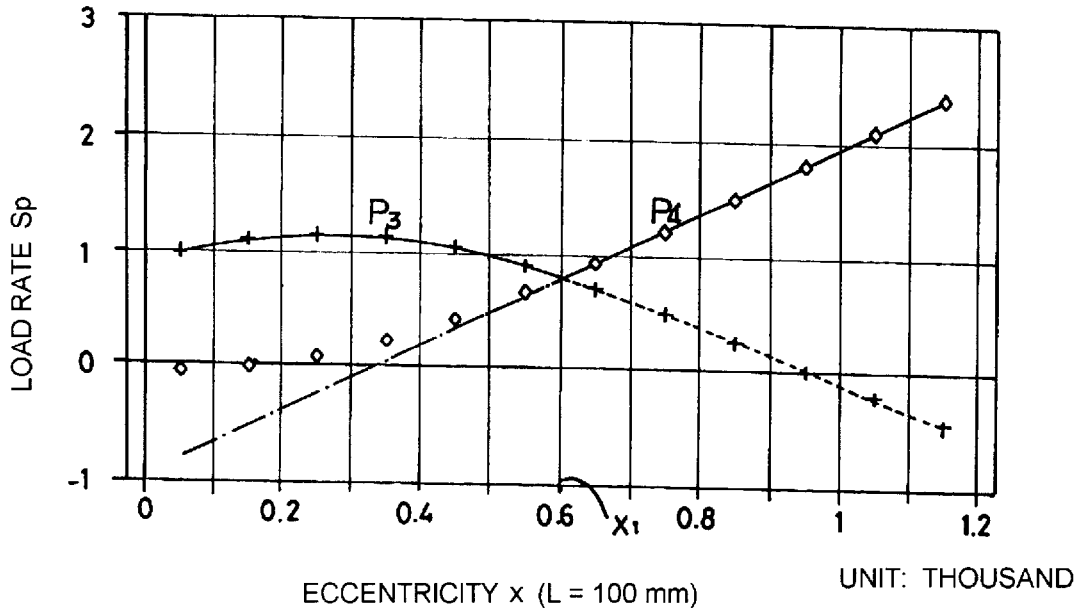
FIG. 21 is a graph showing the relationship between eccentricity and the rate of load.

The load rate Sp can be approximated to the following equations relative to the eccentricity x (see FIG. 21).

(1) when $0\leqq x<x_1$ is satisfied:

$$SP=\sin((x/Pc_{11}+1/Pc_{12})\times\pi)+C5 \quad (3)$$

(2) when $x\geqq x_1$ is satisfied:

$$Sp=Pc_{13}\times x+Pc_{14} \quad (4)$$

C3 to C5=constants $Pc_{11}$ to $Pc_{14}$=values obtained where the bending length L is a variable.

It should be noted that when x=0 in the equation (3), the value of Sp in the equation (3) is equal to the value of Sp obtained from the equation (1).

Now that the load rate Sp is obtained in the way described above, a set value of pressing force per drive shaft depending on the bending length L and the bending position (i.e., eccentricity x) is obtained by multiplying the pressing force BF necessary for bending (including the allowance inherent to the machine) by the load rate Sp. By restraining the pressing force created by each drive shaft from exceeding the set value of pressing force during the phase of pressing workpiece W in bending operation, generation of pressing force more than necessary as well as a shortage of pressing force can be prevented even if the bending length L is short or if off-center bending is performed. This leads to high-accuracy bending.

Figure 22:
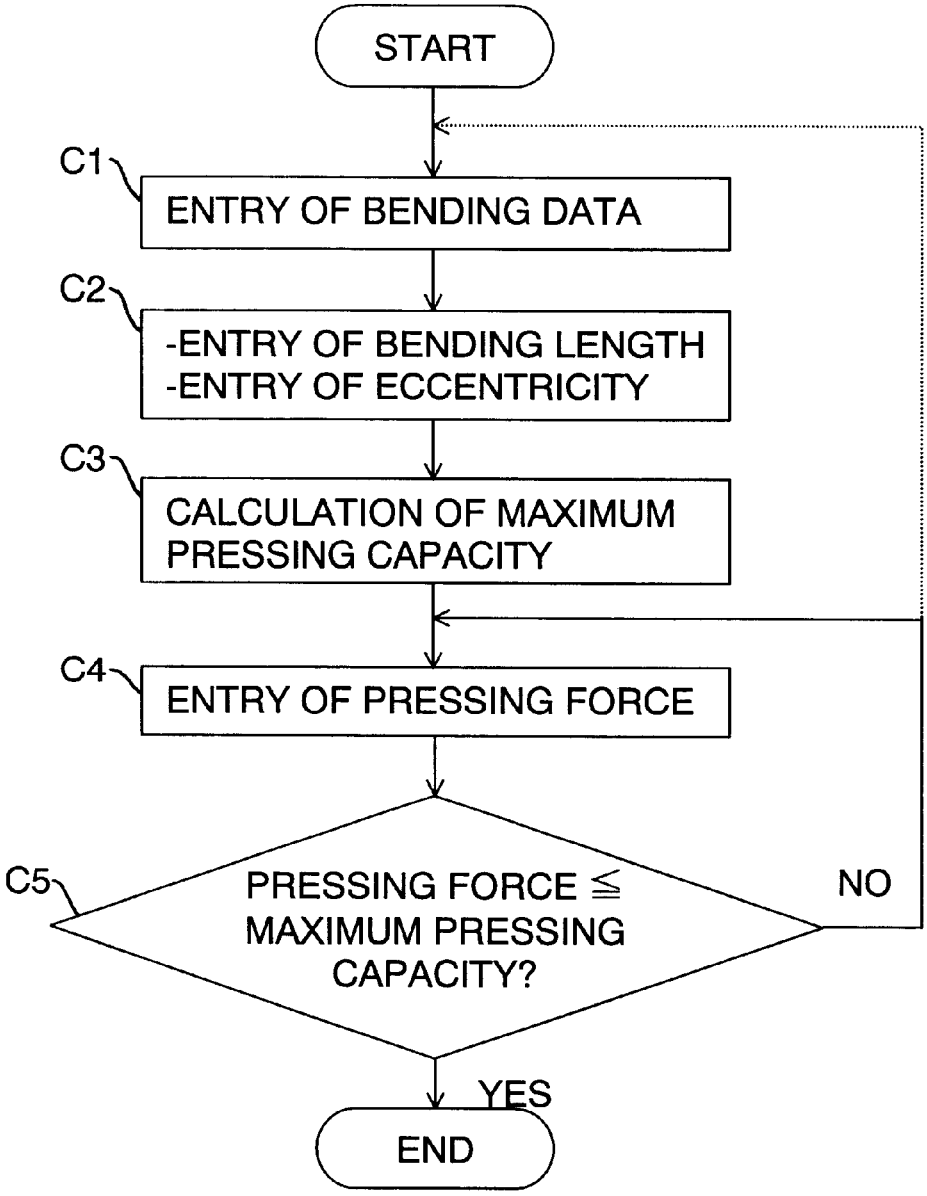
FIG. 22 is a flow chart of a process for setting a pressing force value.

The above-described setting of the pressing force of each drive shaft is performed through the steps shown in the flow chart of FIG. 22. These steps will be described below.

STEPS C1 to C2: Bending process data (the V-groove width of the die 4, the thickness of the workpiece, the tensile strength of the workpiece, etc.) are input through the inputting means, i.e., the operation panel 24 in order to drive the drive shafts. The bending length L and eccentricity x of the workpiece W are also entered.

Figure 23:
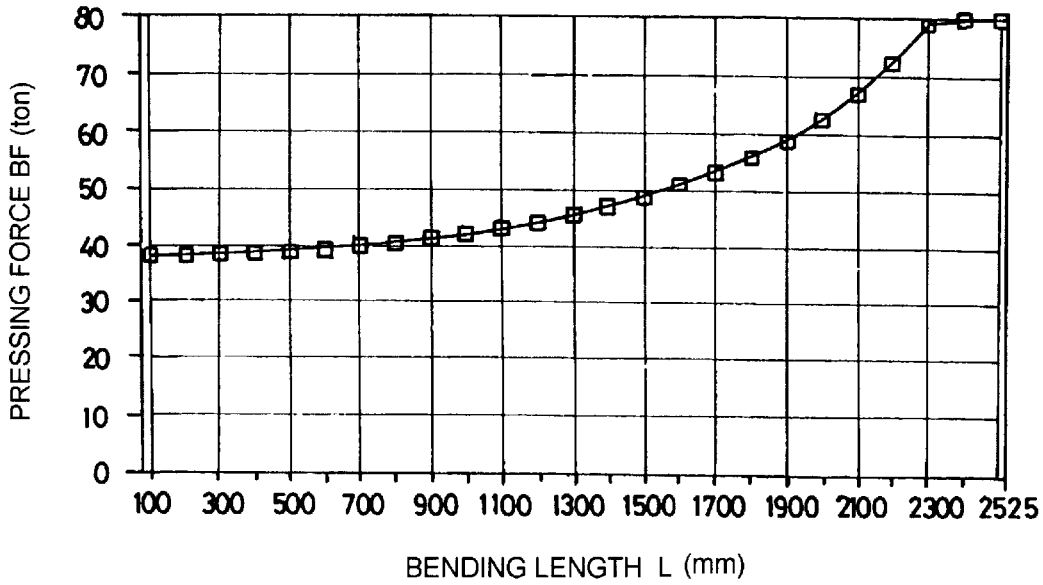
FIG. 23 is a graph showing the change of the maximum load bearable by the machine according to the change of bending length.

STEP C3: The maximum pressing capacity of the machine depending on the bending length L is obtained from the maximum pressing force of one drive shaft. The maximum load of the machine varies as shown in FIG. 23 according to the bending length L. Whether or not bending operation is possible with the capacity of the machine can be determined from the following equation, based on the bending process conditions and on the pressing force BF thus obtained.

$$PF=Pax/(BF\times Sp)$$

PF=pressing capacity

Pax=maximum pressing force generated per drive shaft

BF=pressing force required for bending

STEPS C4 to C5: After inputting the pressing force through the operation panel 24, the NC device 19*a* determines whether or not the input pressing force is equal to or less than the maximum pressing capacity. If the pressing force is equal to or less than the maximum pressing capacity, setting is completed. If the pressing force exceeds the maximum pressing capacity, the display unit 22 then displays it. If such displaying is done by the display unit 22, the operator then inputs a pressing force again (C4) or the flow returns to STEP C1.

Figure 24:
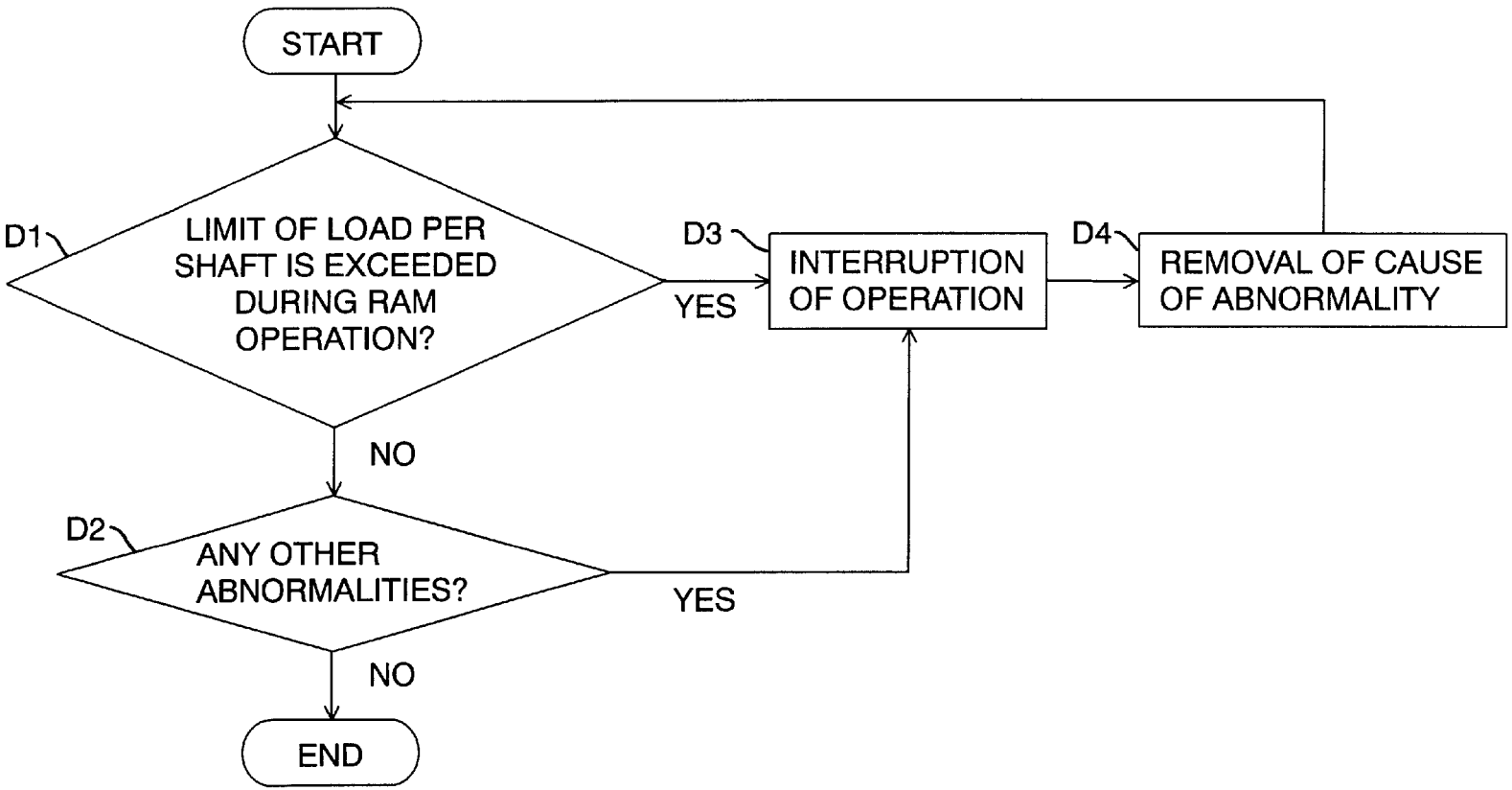
FIG. 24 is a flow chart of a bending process.

Then, bending operation is performed through the steps shown in FIG. 24.

STEP D1 to D2: It is determined whether or not the pressing force generated per drive shaft during bending operation (i.e., the operation of the ram 2) exceeds the set pressing force (the limit of load). If it does not exceed the set value and any other errors do not occur, the bending operation is completed. The pressing force generated per drive shaft is in proportion to the value of current required for the servo motors 11*a* to 11*d* to generate torque. Therefore, the NC device 19*a* issues a signal to the servo amplifiers 15*a* to 15*d*, indicating that the current of the servo motor for each drive shaft should not exceed a value corresponding to the pressing force per drive shaft which has been set through the operation panel 24. In response to the signal, the servo amplifiers 15*a* to 15*d* control to limit the current for the servo motors 11*a* to 11*d*.

STEPS D3 to D4: If the pressing force generated per drive shaft exceeds the set pressing force, or if any other errors have occurred even though the pressing force per drive shaft does not exceed the set value, the operation is interrupted and after removing the causes of the errors, the flow is again started.

In actual bending operation, when the pedal of the foot switch 26 is depressed, the punch 5 rapidly approaches to the workpiece W. Thereafter, a limit for the pressing force to be generated is set and bending of the workpiece W is started by low-speed descending movement (pressing action). After lowering the ram 2 to produce a desired bend angle, high-speed ascending movement is carried out and then stopped at the upper limit, thereby completing one cycle.

In the present embodiment, pressing forces generated by all of the drive shafts are set, based on the load rate Sp of the drive shaft having the highest load rate among four drive shafts. It is also possible to individually control the pressing force of each drive shaft, by obtaining the load rate generated by each drive shaft which varies according to the bending length and bending position of the workpiece.

Figure 25:
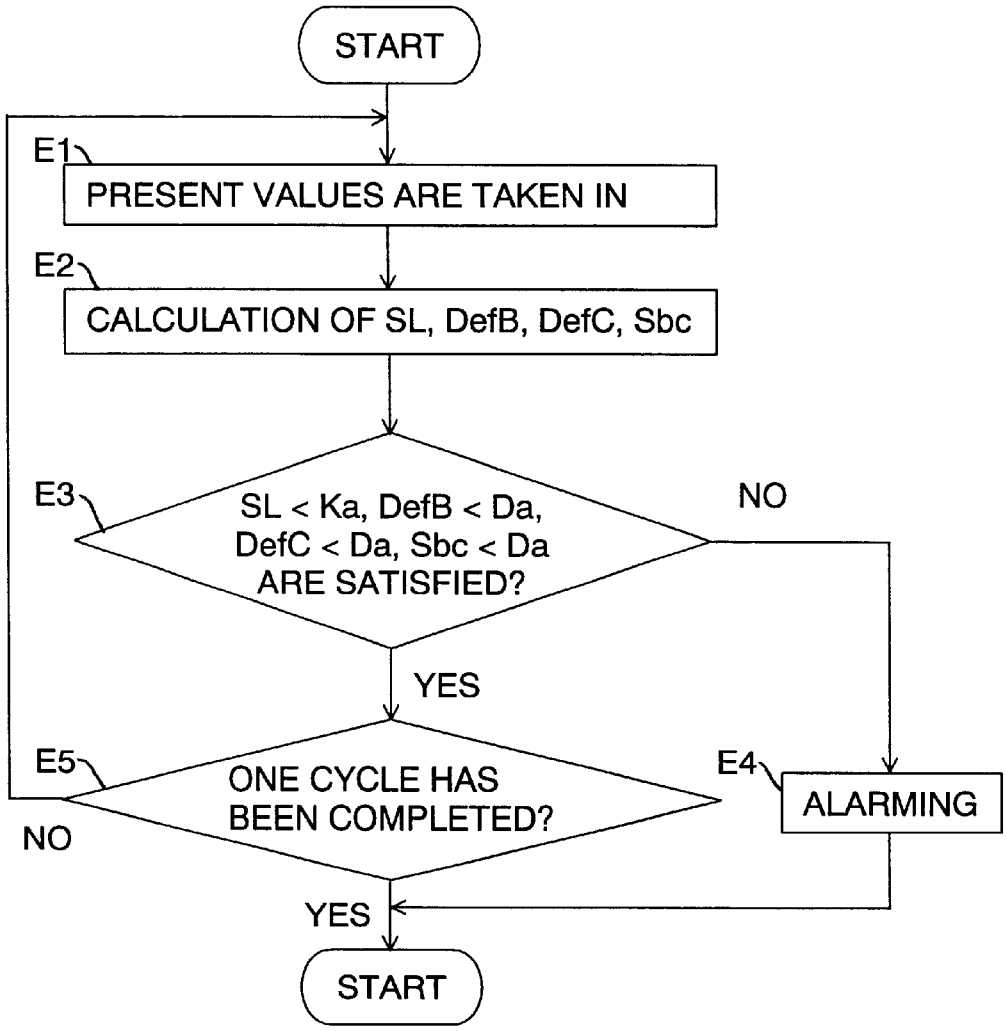
FIG. 25 is a flow chart of a control operation for monitoring occurrence of an error during the operation of the machine.

(IV) Monitoring abnormal movement due to the deflection of the drive shafts:

In the event that any one of the drive shafts is delayed or advanced relative to others for any reasons while the ram 2 being in ascendant or descendant movement in the press brake of the above-described structure, excessive load will be imposed on the coupling part positioned between the abnormal drive shaft and the ram 2, causing damage thereto. In consideration of the possibility of such abnormal situation, the present embodiment is designed to monitor abnormal movement as distinguished from the movement caused by the adjustment of inclining or crowning the ram 2. Next, the control for monitoring abnormal movement during the operation will be described with reference to the flow chart of FIG. 25.

Figure 26:
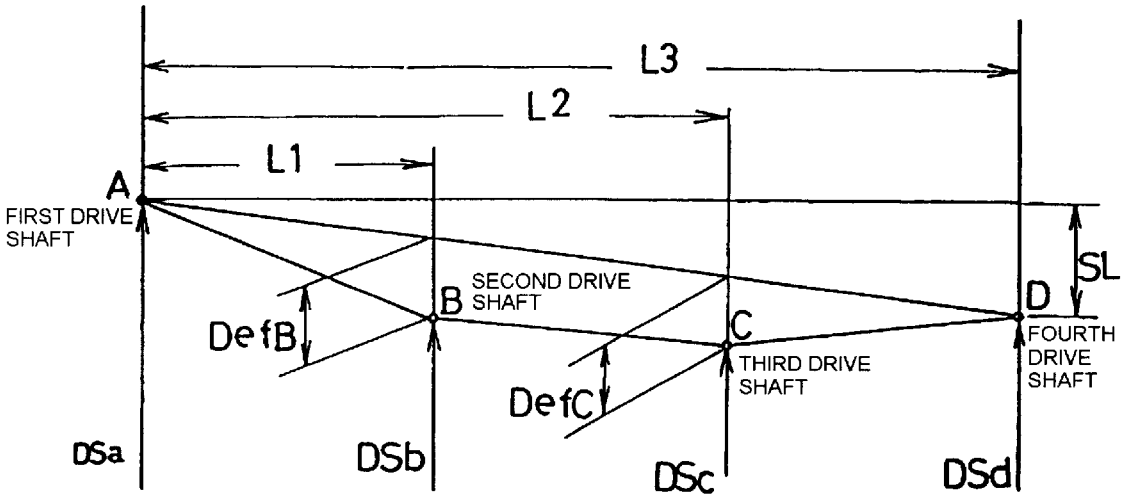
FIGS. 26 and 27 are diagrams each illustrating the displacement condition of each drive shaft.
Figure 27:
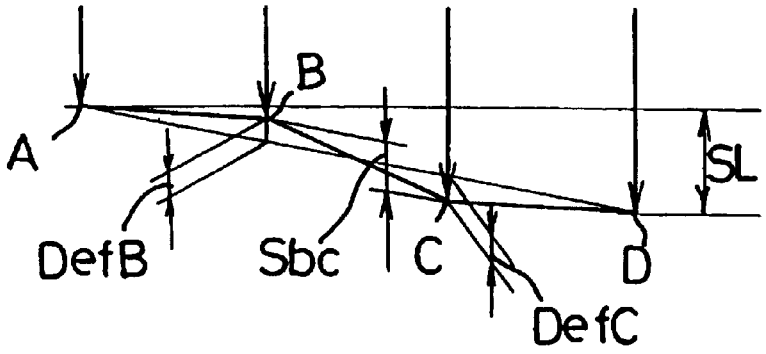

STEP E1 to E2: Data on the present position of each drive shaft are taken in during the movement of the ram 2. As shown in FIG. 26, where the respective positions of four drive shafts at an instant are represented by DSa, DSb, DSc and DSd, the inclination SL of the line connecting the positions of the A drive shaft (the first drive shaft) and the D drive shaft (the fourth drive shaft) is calculated. Also, the deviation (difference) DefB of the B drive shaft (the second drive shaft) from the above connecting line, the deviation DefC of the C drive shaft (the third drive shaft) from the connecting line, and the difference Sbc between the deviation DefB of the B drive shaft and the deviation DefC of the C drive shaft are calculated. SL, DefB, DefC and Sbc are given by the following equations.

$$SL=|DSd-DSa|$$

$$DefB=|DSb-DSa-(DSd-DSa)\times L1/L3|$$

$$DefC=|DSc-DSa-(DSd-DSa)\times L2/L3|$$

$$Sbc=|DSb-DSc-(DSd-DSa)\times(L1-L2)/L3|$$

STEP E3: It is determined whether or not the inclination SL obtained in the foregoing step is less than an allowable inclination value Ka and whether or not the deviation DefB of the B drive shaft, the deviation DefC of the C drive shaft and the difference Sbc between the deviation DefB and the deviation Defc are less than an allowable deflection value Da. In other words, it is determined whether the following inequalities are satisfied.

$$SL<Ka \quad (5)$$

$$DefB<Da \quad (6)$$

$$DefC<Da \quad (7)$$

$$Sbc<Da \quad (8)$$

It should be noted that the value of Da is set to an extremely small value compared to the value of Ka. The reason why the inequality (8) is checked in addition to the inequalities (5) to (7) is that making a judgement with the inequalities (6) and (7) is insufficient when taking into account the case where the B drive shaft and C drive shaft are deviated from the connecting line in opposite vertical directions (i.e., upward and downward).

STEP E4: If any one of the inequalities (5) to (8) is unsatisfied, an informing means such as a display or buzzer sounds an alarm to stop the movement of the ram 2.

STEP E5: If all the inequalities (5) to (8) are satisfied, it is then determined whether one stroke has been terminated. If not, the flow returns to STEP E1.

With the foregoing process, the ram 2 can be inclined or crowned. Further, even if any one of the drive shafts is delayed or advanced relative to others for any reasons, the breakage of the coupling part for the abnormal drive shaft and the ram 2 can be prevented.

Figure 28:
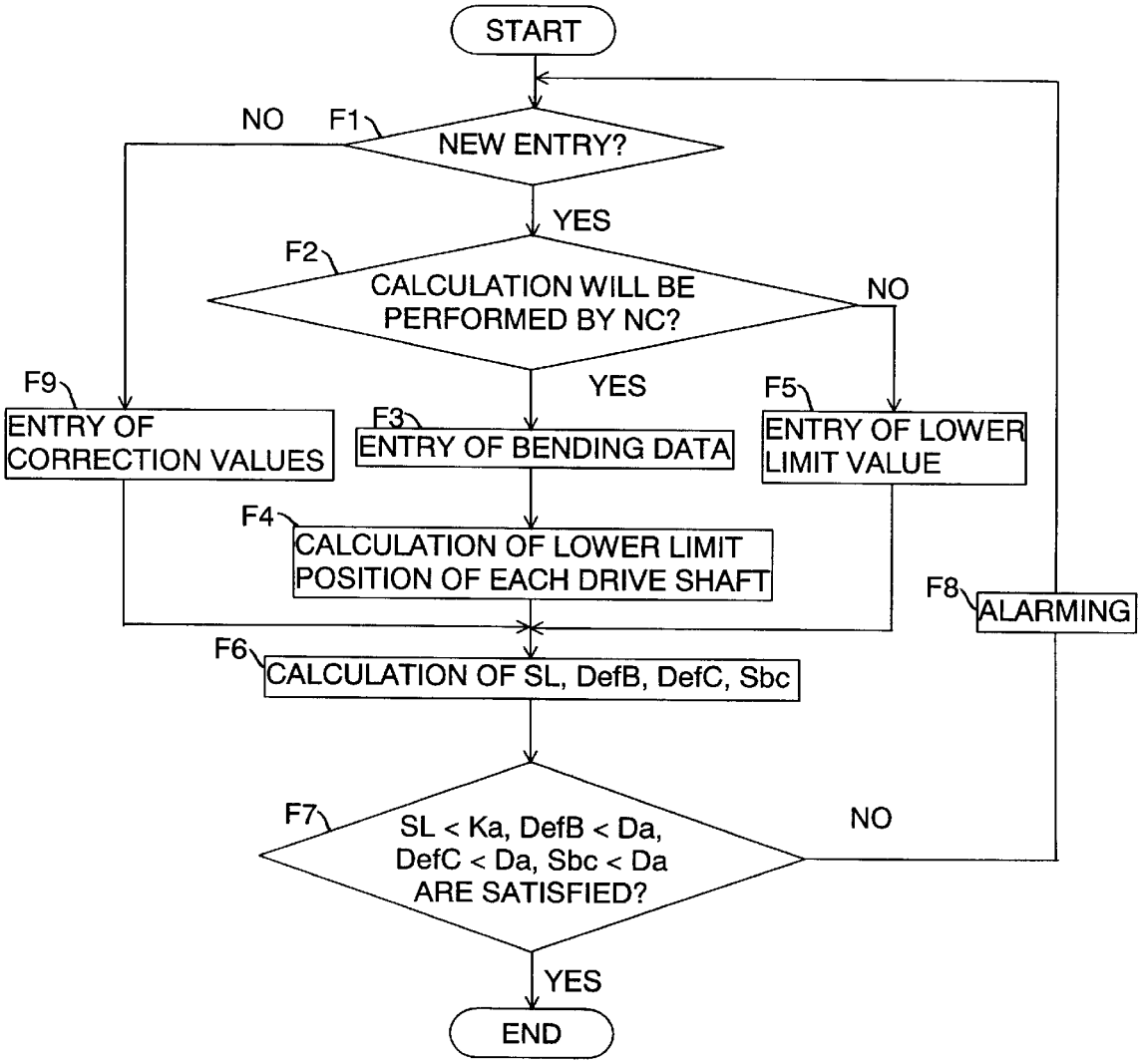
FIG. 28 is a flow chart of a process for setting a target bottom dead center for each drive shaft in order to check a data error.
Figure 29:
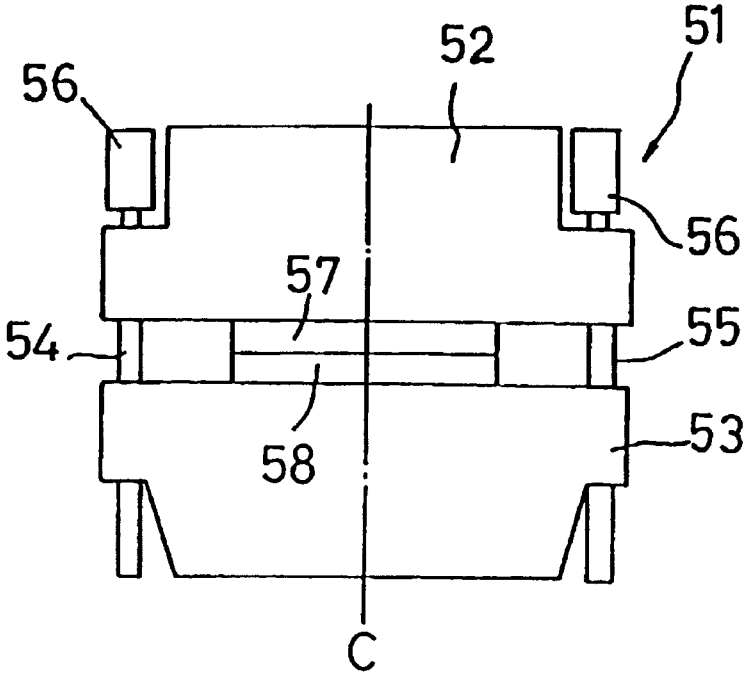
FIG. 29 is a view of a conventional press brake.

Although the detection of abnormal movement is performed during bending of the workpiece in the foregoing description, driving of the ram based on abnormal data can be prevented by making the above judgement with the inequalities (5) to (8) when setting a target lower limit position for each drive shaft according to the input bending process data, prior to the bending operation. The process for setting a target lower limit position for each drive shaft and checking abnormal data will be described with reference to the flow chart of FIG. 28.

STEP F1: It is determined whether bending process data has been newly entered.

STEP F2: If bending process data has been newly entered, it is then determined whether automatic arithmetic operation will be performed by the NC device.

STEPS F3 to F4: After bending process data are entered, a lower limit position for each drive shaft is obtained. In other words, a target closest distance between the punch 5 and the die 4 for each shaft-load imposed point for producing an input target bend angle is obtained.

STEP F5: If automatic arithmetic operation will not be performed by the NC device, a lower limit position for each drive shaft is input manually.

STEP F6: In the way similar to STEP E2 in FIG. 25, the inclination SL of the line connecting the positions of the A drive shaft and the D drive shaft, the deviation DefB of the B drive shaft from the connecting line, the deviation DefC of the C drive shaft from the connecting line and the difference Sbc between the deviation DefB and the deviation DefC are calculated.

STEP F7: Similarly to STEP E3 in FIG. 25, determination is made to check if the following inequalities are satisfied.

$$SL<Ka \quad (5)$$

$$DefB<Da \quad (6)$$

$$DefC<Da \quad (7)$$

$$Sbc<Da \quad (8)$$

STEP F8: If any one of the inequalities (5) to (8) is not satisfied, an informing means such as a display or buzzer sounds an alarm and the program returns to STEP F1.

STEP F9: If the bending process data is not newly input data, data entry is done by inputting correction values for the previously input data and then, the program proceeds to STEP F6.

While an abnormal situation is detected when any one of the inequalities (5) to (8) is unsatisfied in the present embodiment, it may be detected upon condition that either the inequality (6) or (7) is satisfied or that any one of the inequalities (5) to (7) is satisfied.

The present embodiment has been illustrated in the form of a so-called overdrive type press brake in which an upper die is attached to the ram (movable member), with a lower die mounted on the table (fixed member). As a matter of course, the invention can be applied to so-called underdrive type press brakes in which the lower die is attached to the ram (movable member) while the upper die being mounted on the table (fixed member).

While each of the driving sources for the ram includes an AC servo motor and ball screw in the present embodiment, driving sources including a hydraulic unit and a cylinder may be employed.

The present embodiment has been described with four ram drive shafts, it is readily apparent that the invention can be applied to machines having three drive shafts or five or more drive shafts.

What is claimed is:

1. A bending method for use in a bending machine which bends a sheet-like workpiece by the cooperative movement of a movable die and a fixed die, the movable die being supported by a ram having three or more drive shafts, acting at respective shaft-load imposed points and the fixed die being supported in an opposing relationship with the movable die by a table both ends of which are secured, the bending method comprising the steps of:

obtaining, by using calculations based on bending process data, a deformation amount of the ram and a deformation amount of the table at the respective shaft-load imposed points which correspond to the positions of the drive shafts;

obtaining, by using calculations based on said deformation amounts of the ram and table, a target closest distance between the movable die and the fixed die at each shaft-load imposed point according to its associated deformation amounts; and driving the ram by independently controlling each drive shaft according to the target closest distance associated with it.

2. A bending apparatus for use in a bending machine which bends a sheet-like workpiece by the cooperative movement of a movable die and a fixed die, the movable die being supported by a ram having three or more drive shafts, acting at respective shaft-load imposed points, and the fixed die being supported in an opposing relationship with the movable die by a table both ends of which are secured, the bending apparatus comprising:

(a) die deformation amount calculating means for calculating, according to input bending process data, a deformation amount of the ram and a deformation amount of the table at respective shaft-load imposed points which correspond to the positions of the drive shafts;

(b) closest distance calculating means for calculating, according to the deformation amounts calculated by the die deformation amount calculating means, a target closest distance between the movable die and the fixed die at each shaft-load imposed point; and (c) ram driving means for driving the ram by independently controlling each drive shaft, according to the result of the calculation performed by the closest distance calculating means.

3. A bending apparatus for use in a bending machine, according to claim 2, further comprising position detecting means for detecting a present position of each shaft-load imposed point of the ram, wherein said ram driving means controls the ram such that the present position of the ram detected by the position detecting means is coincident with a target position.

4. A bending apparatus for use in a bending machine, according to claim 3, further comprising side frames and a correction bracket, wherein said position detecting means is supported by the correction bracket so as to be unaffected by deflection of the side frames due to changes in load.

5. A bending apparatus for use in a bending machine, according to any one of claims 2 to 4, further comprising input-output means for inputting said bending process data and displaying various data including calculation results.

* * * * *